US011286655B2

(12) United States Patent
Smith et al.

(10) Patent No.: US 11,286,655 B2
(45) Date of Patent: Mar. 29, 2022

(54) UNIVERSAL CANISTER FLUSH VALVE

(71) Applicant: Kohler Co., Kohler, WI (US)

(72) Inventors: Andrew L. Smith, Sheboygan, WI (US); Billy Jack Ahola, Manitowoc, WI (US); Donald G. Bogenschuetz, Sheboygan, WI (US); Lawrence E. Duwell, Belgium, WI (US); Peter W. Swart, Oostburg, WI (US); Jeffrey T. Laundre, Sheboygan, WI (US); Bradley Strasser, Fredonia, WI (US); Matthew Krebs, Cedarburg, WI (US); Douglas E. Bogard, Sheboygan, WI (US); Daniel N. Halloran, Fredonia, WI (US); Scott R. Krebs, Sheboygan Falls, WI (US); Edward F. Malis, Jr., Sheboygan, WI (US); Randy O. Mesun, Sheboygan, WI (US); Eric Derner, Sobieski, WI (US); Stewart Anthony Schaal, Lakewood, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 16/791,689

(22) Filed: Feb. 14, 2020

(65) Prior Publication Data

US 2020/0263405 A1 Aug. 20, 2020

Related U.S. Application Data

(60) Provisional application No. 62/806,238, filed on Feb. 15, 2019.

(51) Int. Cl.
*E03D 1/34* (2006.01)
*E03D 1/14* (2006.01)

(52) U.S. Cl.
CPC ..... *E03D 1/34* (2013.01); *E03D 1/142* (2013.01)

(58) Field of Classification Search
CPC .. E03D 1/33; E03D 1/34; E03D 1/142; E03D 1/14; E03D 1/35
(Continued)

(56) References Cited

U.S. PATENT DOCUMENTS 3,587,117 A * 6/1971 Ward ..... E03D 1/34 4/385
4,486,906 A 12/1984 Meier
(Continued)

FOREIGN PATENT DOCUMENTS

DE 10 2016 108 510 11/2017
DE 102016108510 A1 11/2017
(Continued)

OTHER PUBLICATIONS

PCT Annex to Form PCT/ISA/206 Communication Relating to the Results of the Partial International Search for corresponding International Application No. PCT/US2020/018345 dated May 27, 2020.
(Continued)

*Primary Examiner* — Benjamin R Shaw
(74) *Attorney, Agent, or Firm* — Lempia Summerfield Katz LLC

(57) ABSTRACT

A universal canister flush valve having a valve body configured to be fixed relative to a toilet tank and having a hollow wall defining an internal flow passage; a guide post coupled to and extending away from the valve body; a float fitted about and configured to slide relative to the guide post between a closed position and an open position, the float having an open top; and an extender that selectively couples to the open top in a first position, in which a first end of the extender is received in and coupled to the open top, and in
(Continued)

a second position, in which a second end of the extender is received in and coupled to the open top, wherein the extender and float define a first overflow height in the first position and define a second overflow height in the second position.

14 Claims, 15 Drawing Sheets

(58) Field of Classification Search
USPC ..... 4/398
See application file for complete search history.

(56) References Cited

U.S. PATENT DOCUMENTS 5,502,846 A 4/1996 Chelchowski
5,803,114 A 9/1998 Johnson
6,006,371 A 12/1999 Korte
6,442,772 B2 9/2002 Han et al.
6,658,673 B2 12/2003 Hand
6,715,162 B2 4/2004 Han et al.
6,728,975 B2 5/2004 Han
7,200,877 B2 4/2007 Peng
7,636,958 B2 12/2009 Nichols-Roy et al.
7,895,684 B2 3/2011 Denzin
8,112,829 B2 * 2/2012 Shieh ..... E03D 1/34 4/397
8,365,320 B1 2/2013 Lordahl
9,328,494 B2 5/2016 Yyoshioka et al.
9,359,752 B2 6/2016 Le et al.
2002/0095719 A1 * 7/2002 Hand ..... E03D 1/145 4/326
2007/0101485 A1 * 5/2007 Denzin ..... F16K 21/16 4/378
2009/0255043 A1 * 10/2009 Halloran ..... E03D 1/35 4/378
2010/0024114 A1 * 2/2010 Hand ..... E03D 1/145 4/395
2013/0283514 A1 * 10/2013 Hand ..... E03D 1/35 4/395
2014/0223656 A1 * 8/2014 Liu ..... E03D 1/34 4/410
2017/0167125 A1 * 6/2017 Tanimoto ..... E03D 1/35

FOREIGN PATENT DOCUMENTS

WO WO-2007/056329 5/2007
WO WO2007056329 A2 5/2007

OTHER PUBLICATIONS

Foreign Search Report on PCT PCT/US2020/018345 dated Jul. 22, 2020.
PCT International Preliminary Report on Patentability and Written Opinion of International Searching Authority, corresponding to PCT International Application No. PCT/US2020/018345 dated Aug. 26, 2021.

* cited by examiner

FIG. 3
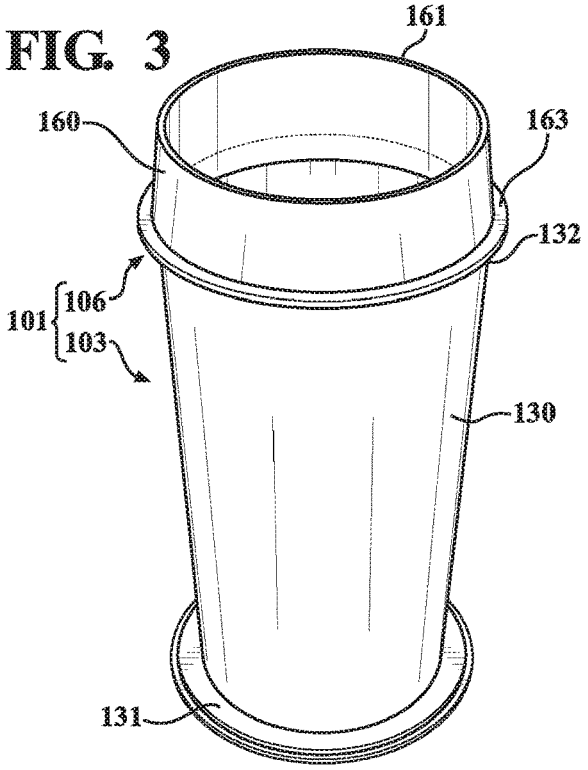
FIG. 4
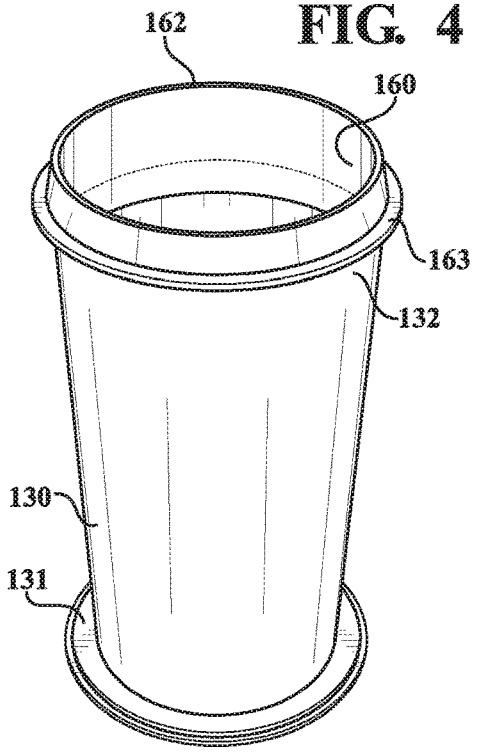
FIG. 5
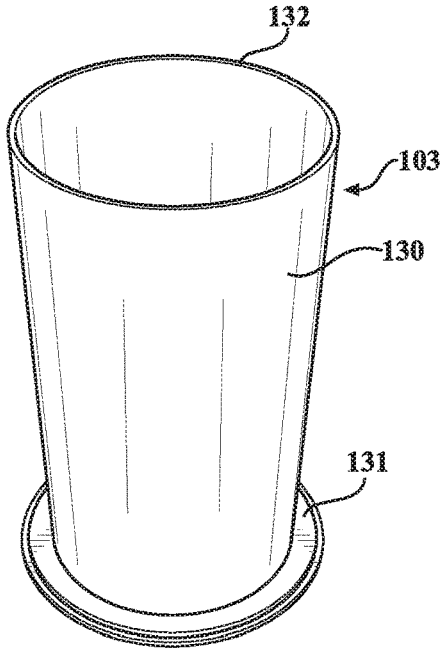
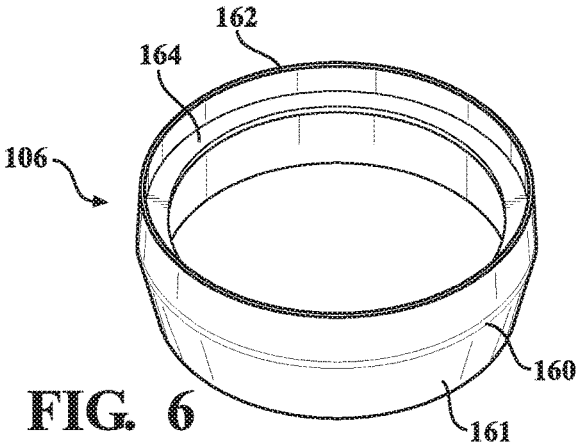
FIG. 6
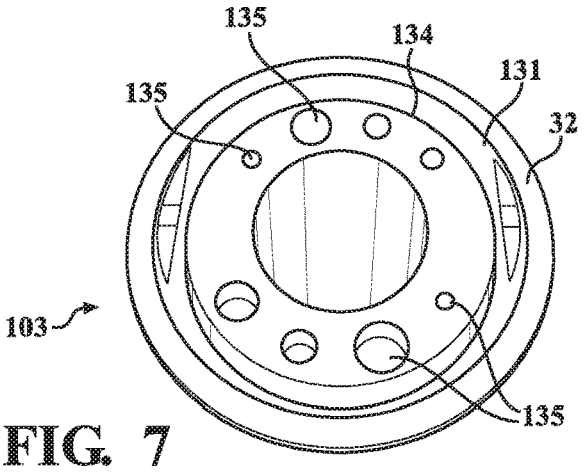
FIG. 7

FIG. 14
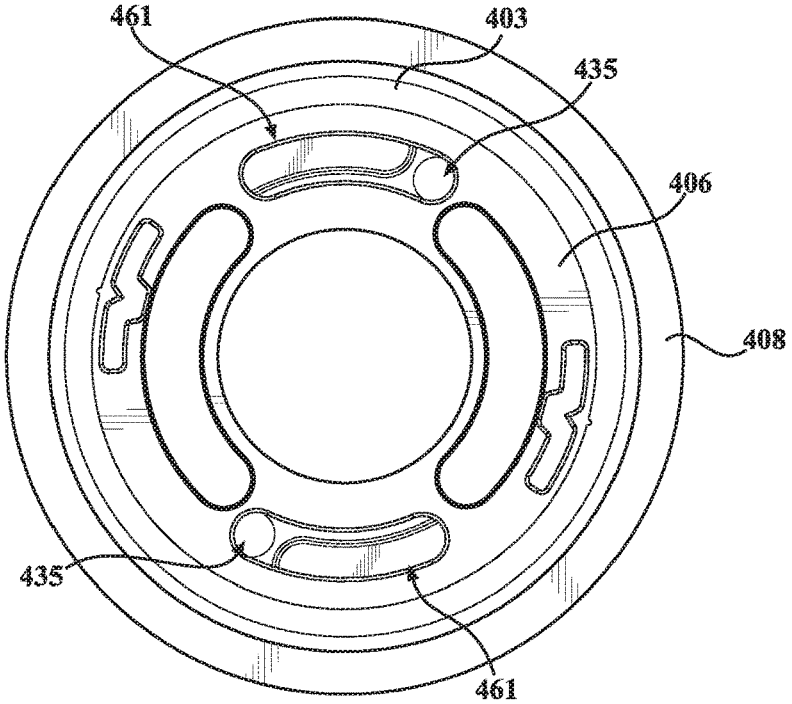
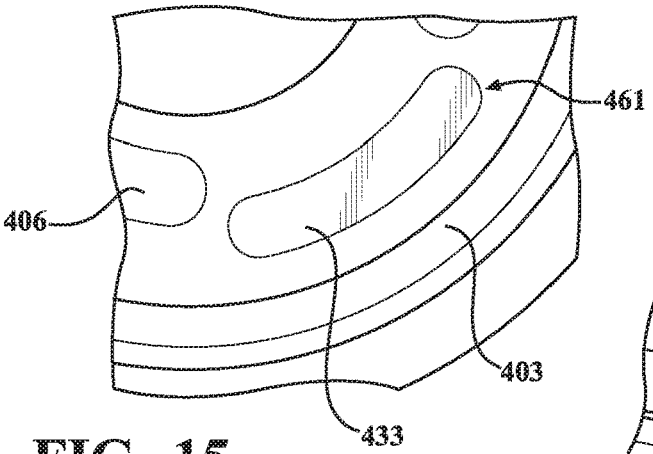
FIG. 15
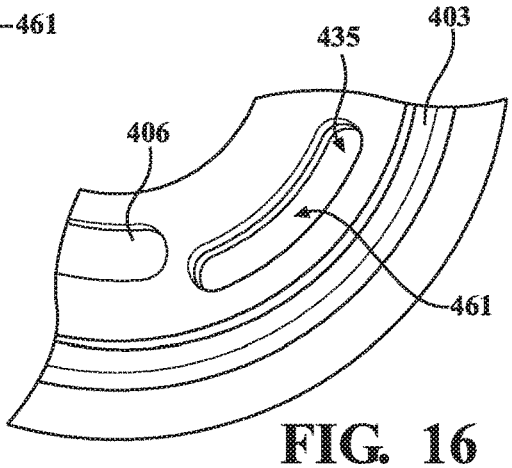
FIG. 16
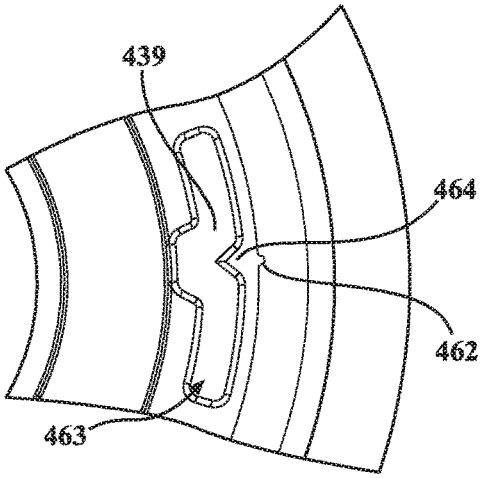
FIG. 17

UNIVERSAL CANISTER FLUSH VALVE

CROSS-REFERENCE TO RELATED APPLICATIONS

The present application claims the benefit of and priority to U.S. Provisional Patent Application No. 62/806,238, filed on Feb. 15, 2019. The aforementioned U.S. application is incorporated by reference, herein in its entirety.

BACKGROUND

The present application relates generally to the field of canister flush valves for toilets. More specifically, this application relates to canister flush valves that are configured to fit universally with a multitude of different toilet configurations.

Presently there are a multitude of differently configured canister flush valves on the market to accommodate an ever increasing number of toilet designs on the market, as well as differences both structurally (e.g., tank height variations) and functionally (e.g., valve timing variations) between these various toilet designs. The number of variations of canister flush valves drives up cost (e.g., piece cost, manufacturing cost, service cost, etc.) and introduces complexity associated with, for example, manufacturing and servicing the toilets and valves. By way of example, the added complexity makes it difficult for customers to fix problems associated with their toilet/flush valve, since they may not know which variant they have or what replacement parts are intended for the valve in their toilet.

Thus, there is a need to provide a universal canister style flush valve that can accommodate the differences in structure and function among the large number of toilets currently on the market and those that will come.

SUMMARY

At least one embodiment of the present application relates to a universal canister flush valve that includes a valve body configured to be fixed relative to a toilet tank and having a hollow wall defining an internal flow passage; a guide post coupled to and extending away from the valve body; a float fitted about and configured to slide relative to the guide post between a closed position and an open position, the float having an open top; and an extender that selectively couples to the open top in a first position, in which a first end of the extender is received in and coupled to the open top, and in a second position, in which a second end of the extender is received in and coupled to the open top. The extender and float define a first overflow height in the first position and define a second overflow height in the second position.

At least one embodiment of the present application relates to a universal canister flush valve that includes a valve body, a guide post, a float, and a disc. The valve body is configured to fixedly couple to a toilet and has a hollow wall defining a flow passage. The guide post couples to and extends away from the valve body. The float fits about and is configured to move relative to the guide post between a closed position and an open position. The float includes an outer wall extending between a first end and a second end, which is open; an inner wall configured to move along the guide post; and a bottom wall extending between the inner wall and the outer wall. The disc rotatably couples to the float and is disposed adjacent to the bottom wall or a top of the inner wall, such that relative rotation between the disc and the float adjusts at least one port of the disc relative to at least one opening in the bottom wall or the top of the inner wall to a change a flow area of the flush valve.

At least one embodiment of the present application relates to a universal canister flush valve that includes a valve body, a guide post, a float, and a covering member. The valve body is configured to fixedly couple to a toilet and has a hollow wall defining a flow passage. The guide post couples to and extends away from the valve body. The float fits about and is configured to move relative to the guide post between a closed position and an open position. The float includes an outer wall extending between a first end and a second end, which is open, the outer wall having at least one first opening at a first distance from the second end and at least one second opening at a second distance from the second end. The float includes an inner wall configured to move along the guide post. The covering member adjustably couples to the float, such that the covering member covers the first opening in a first position to define a first overflow height, the second opening in a second position to define a second overflow height, and both the first and second openings in a third position to define a third overflow height.

BRIEF DESCRIPTION OF THE FIGURES

The disclosure will become more fully understood from the following detailed description, taken in conjunction with the accompanying figures, wherein like reference numerals refer to like elements, in which:

FIG. 3 is a perspective view of a flush valve in a first configuration.

FIG. 4 is a perspective view of a flush valve in a second configuration.

FIG. 5 is a perspective view of a flush valve in a third configuration.

FIG. 6 is an exemplary embodiment of an end extension of a flush valve.

FIG. 7 is a bottom perspective view of a float for a flush valve.

FIG. 14 is a bottom view of a disc assembled to the float shown in FIG. 9.

FIG. 15 is a detail view of a portion of the disc and float shown in FIG. 14 in a closed position.

FIG. 16 is a detail view of a portion of the disc and float shown in FIG. 14 in an open position.

FIG. 17 is a detail view of a portion of the disc and float shown in FIG. 14.

DETAILED DESCRIPTION

Before turning to the Figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring generally to the Figures, disclosed herein are canister flush valves configured to provide an adjustable buoyancy to provide an adjustable timing of the flush and/or provide an adjustable overflow height, such that the canister flush valves can advantageously be used universally with any number of toilets. Given the large number of different toilet flush valves that are presently on the market due to differences in design and performance of the toilets employing the valves, the universal flush valves of this application can eliminate or reduce confusion related to what type of valve is employed with a specific toilet as well as drive down cost.

The timing of the flush is generally regulated by fixed holes in the bottom of the canister, which are controlled by gates in the injection molding tool, hence the parts/floats are configured not to be adjustable. At least one embodiment of this application regulates the rate at which water enters the valve by providing the canister with a plastic ring that is rotatable to open/close one or more holes, openings or slots to control a flow area. At least one embodiment utilizes one or more small snap covers that remain in place on the valve and move up/down to open/close an opening associated with the snap cover. At least one embodiment includes small circular sliders that slide (e.g., laterally) over each hole and remain on the canister. At least one embodiment includes one or more plugs associated with one or more holes in the bottom of the float, where each plug can be coupled to or separated from the canister (e.g., float), such as by the customer, to change a flow area of the valve/float.

Adjusting the overflow height of the canister is important because although code requirements (e.g., IAPMO, no system flow for 5 minutes, etc.) can drive performance here, internal requirements for products can be more stringent than code requirements. Further, different designs of toilets have different overflow height. Thus, a universal canister flush valve should provide adjustable overflow height to accommodate different heights. At least one embodiment includes an additional piece that can couple (e.g., snap) to a top of the float in two different ways (by flipping the piece over) to create different heights. At least one embodiment includes holes in a side of the canister (e.g., float), where a person (e.g., customer, installer, etc.) can use provided plugs to fill the correct hole(s) to tailor the canister/valve overflow height to their toilet design (i.e., the same height as their old canister/valve).

Figure 1:
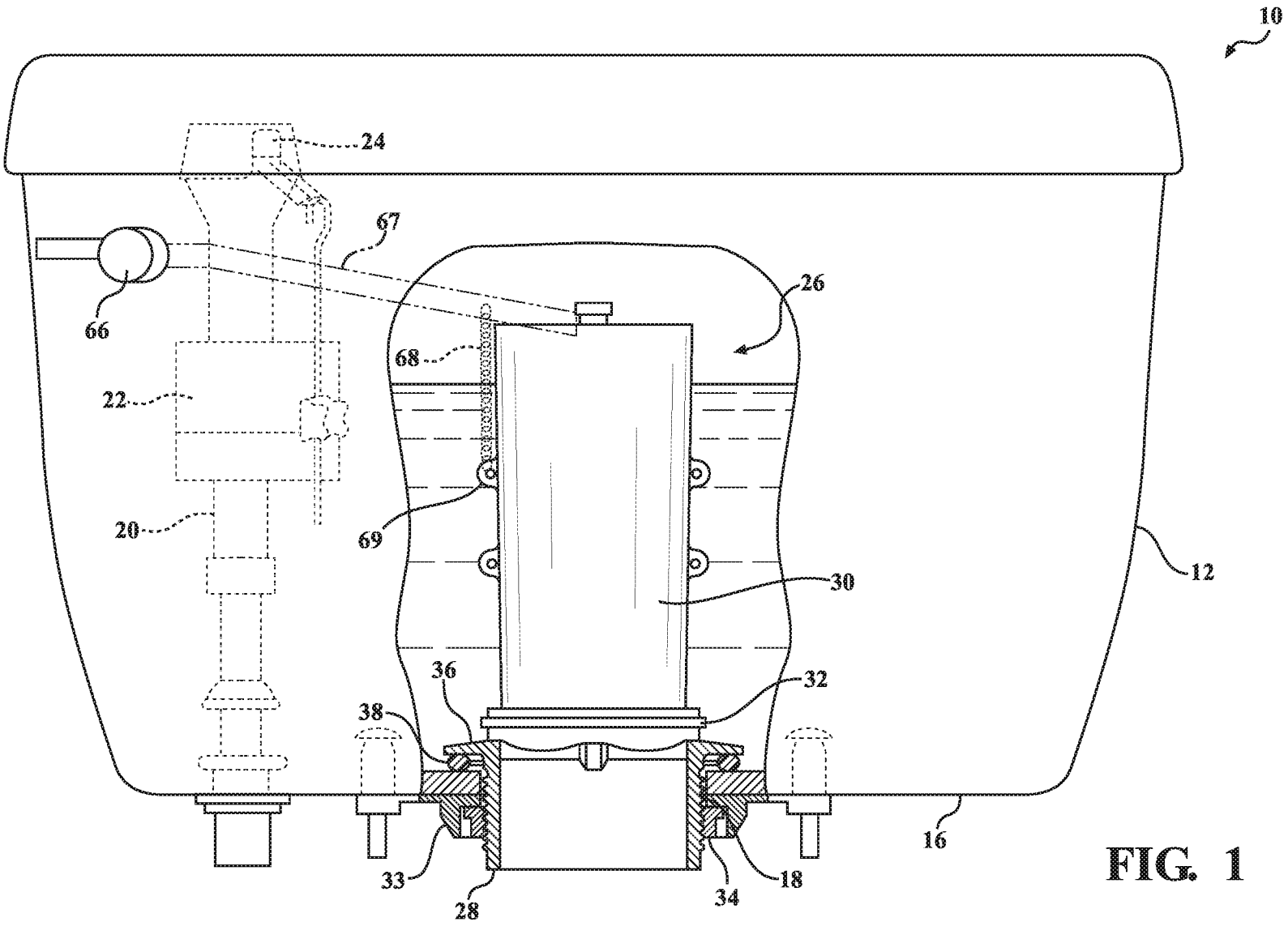
FIG. 1 is a partially cutaway front view of a toilet tank having a fill valve and a flush valve, according to an exemplary embodiment.
Figure 2:
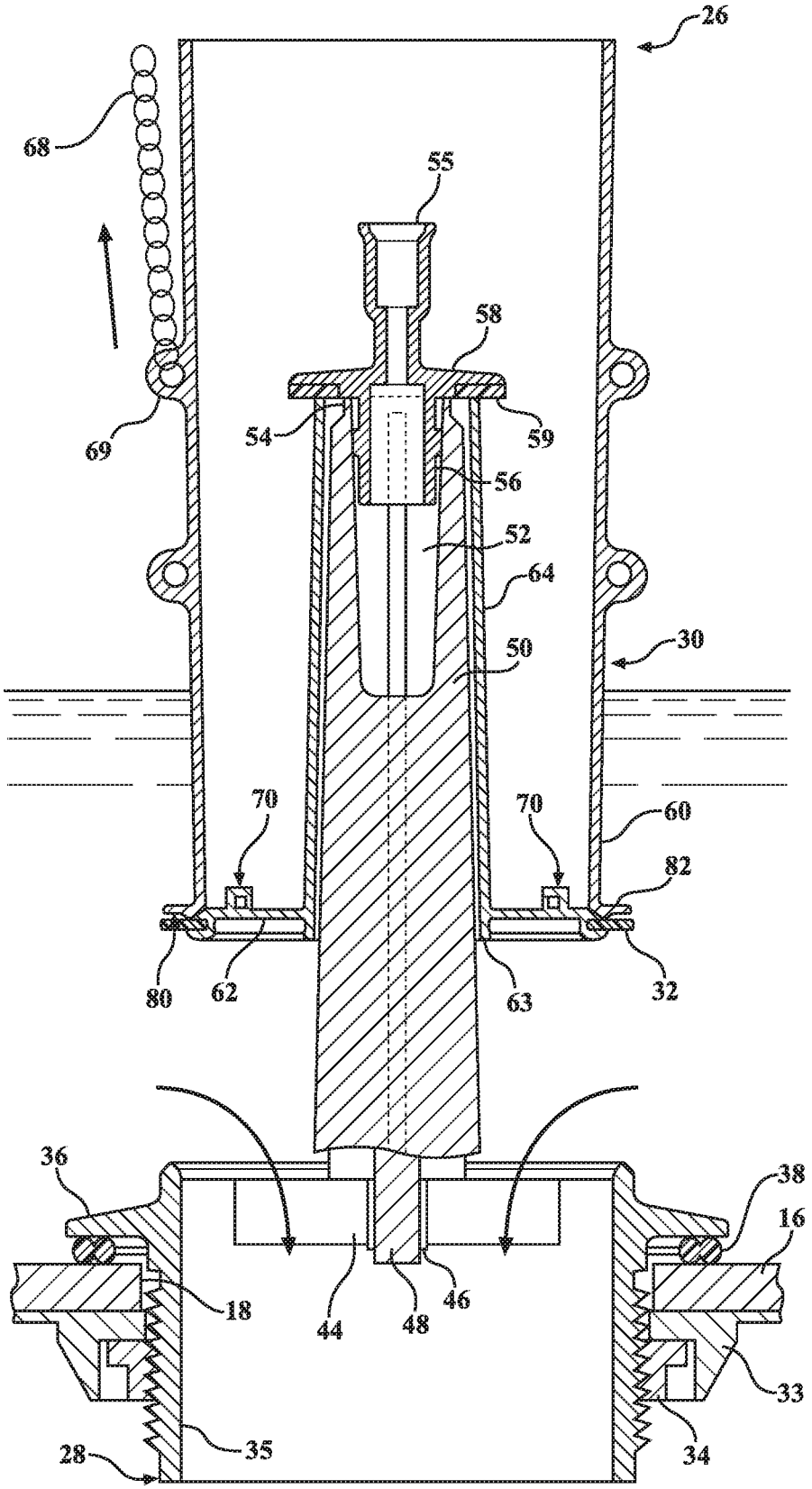
FIG. 2 is a cross-sectional view of the tank and flush valve shown in FIG. 1.

FIGS. 1 and 2 illustrate an exemplary embodiment of a canister-style flush valve 26 (e.g., flush valve assembly) for controlling the flow of water from a tank 12 of a toilet 10 to a bowl (not shown). Also shown mounted inside the tank 12 is a water supply pipe 20 having a float 22 operated supply valve 24 for controlling the flow of water into the tank 12 from a source (e.g., a water line). The illustrated flush valve 26 includes a valve body 28, which extends through an outlet opening 18 in a bottom wall 16 of the tank 12 (when installed), a float 30 operably (e.g., movably, slidably, etc.) coupled to the valve body 28 through a guide post 50, a seal 32 carried by the float 30 and configured to selectively seal against a valve seat of the valve body 28 in a closed position (as shown in FIG. 1). The flush valve 26 can include a valve nut 34, which threads to the valve body 28 to secure the flush valve 26 in place to the tank 12 (e.g., to the bottom wall 16), and/or a gasket 33 carried by the valve body 28 and/or the valve nut 34 and configured to seal between the bowl (e.g., an inlet) and the tank 12 (e.g., the outlet opening 18) to ensure that flush water flowing through the valve body is transferred to the bowl without leaking water.

The illustrated valve body 28 includes a hollow longitudinal wall 35 that defines an internal flow passage and has external threads that thread to the valve nut 34. The illustrated valve body 28 also includes a flange 36 that extends radially outward from the longitudinal wall 35. Upon installation, the flange 36 can retain (e.g., clamp) a gasket 38 between a topside of the bottom wall 16 of the tank 12 and an underside of the flange 36. The valve body 28 also includes an inner structure 44, which can be open cross-bracing to allow water flow (as depicted by the arrows in FIG. 2), having an opening 46 that receives a mounting stem 48 of guide post 50 to fixedly couple the guide post 50 to the valve body 28.

The illustrated guide post 50 includes a cross-shaped body having a central opening 52 and a ring 54 at an upper end. A stop 56 of a cap is received in the opening 52, and the cap is retained by the post 50 such as through a quarter-turn arrangement/coupling. A radial flange 58 of the cap is shown backing a gasket 59. The cap is hollow and open ended so that a water line for refilling the bowl (not shown) and coming from the supply inlet valve can be attached to a fitting 55 above the flange 58.

The illustrated float 30 is configured as an upright, cup-shaped, unitary body that is integrally formed with an outer wall 60, a bottom or bottom wall 62, and an inner wall 64. The illustrated outer wall 60 has a longitudinal cylindrical (e.g., frusto-conical) shape with an upper end that is open to the ambient air above the tank water. The illustrated inner wall 64 (e.g., a central longitudinal overflow tube) fits about the guide post 50 to mount the float 30 to the valve body 28 (e.g., through the guide post 50). The illustrated bottom wall 62 extends radial between a lower or bottom portion of the outer wall 60 and a lower or bottom portion of the inner wall 64. Should the tank 12 be filled above its water fill height, overflow water will spill over the open upper end of the outer wall 60 to the interior of the float 30. The overflow water can drain from the float 30 and out of the tank through the internal flow passage in the valve body 28, such as through bleed holes or openings 70 in the bottom wall 62. If the overflow water enters the float 30 faster than it is drained, it will begin to fill the float 30 until it reaches the open upper end of the inner wall 64, after which it will drain through the inner wall 64 (around the guide post 50) and exit through an opening 63 in the bottom wall 62 at the lower end of the inner wall 64. Also, after a flush, water from the refill line is configured to fill the bowl by passing from the refill line through the stop 56 and the inner wall 64 (again around the post 50 and out the large, central opening in the bottom wall 62) and the flow passage of the valve body 28.

A lower end of the float 30 defines an annular circumferential seal retaining groove 80, which opens outwardly in a radial direction (relative to the longitudinal direction). The seal 32 fits about the float 30, such as concentric with a central axis, and the seal 32 is retained in the groove 80 in a generally radial orientation. The float 30 may, optionally, include a backing flange 82 located adjacent to the groove 80 and extending circumferentially and radially, such as on a side of the groove 80 opposite the valve seat 40.

An actuator (e.g., a trip lever 66 shown in FIG. 1) can control flushing of the toilet 10 by moving (e.g., sliding, lifting, etc.) the float 30 from the closed position to an open position (as shown in FIG. 2), such as by moving (e.g., rotating) a lever arm 67 and/or a chain 68 operatively coupling the float 30 to the lever arm 67 and/or actuator. For example, the chain 68 can connect to a tab or eyelet 69 located on an outside of the float 30, so that rotation of the lever 66 in turn rotates the lever arm 67, which in turn lifts/slides the float 30 upwardly from the closed position to the open position.

FIGS. 3-6 illustrate an exemplary embodiment of a float assembly 101 for a flush valve having a float 103 and an end extension 106 (e.g., end member, extender, etc.) that selectively couples to the float 103 in two different positions to vary the height of the float assembly 101. The float 103 includes a longitudinally extending outer wall 130 extending between a first or lower end 131 and a second or upper end 132. The upper end 132 is open to receive the end extension 106, as shown in FIGS. 3 and 4.

As shown in FIG. 6, the end extension 106 includes a hollow cylindrical body 160 that is shaped like a sleeve and extends in the longitudinal direction (e.g., vertically) between a first end 161 and a second end 162. One or more flanges or ribs can be configured to extend radially from an inner surface or an outer surface of the body 160. As shown in FIGS. 3 and 4, a flange 163 extends radially (e.g., transverse to the longitudinal direction) outward from an outer surface of the body 160. The flange 163 can extend around the entire circumference or profile of the body 160 or can include one or more semi-circular sections separated from adjacent sections. The flange 163 is offset from the midpoint or midsection in a longitudinal direction, such that the flange 163 is located at a first distance from the first end 161 and located at a second distance from the second end 162, where the first and second distances are different.

In a first position or tallest configuration, as shown in FIG. 3, the second end 162 of the end extension 106 is inserted into the open second end 132 of the outer wall 130 of the float 103 until the flange 163 contacts an end surface of the second end 132. In the first position, the first end 161 of the end extension 106 extends upwardly beyond the second end 132 of the float 103, such that the height of the float assembly 101 is equal to the first distance (i.e., the distance from the first end 161 to the flange 163) plus the height of the float 103 (e.g., length/height of the outer wall 130).

In a second position or medium height configuration, as shown in FIG. 4, the first end 161 of the end extension 106 is inserted into the open second end 132 of the outer wall 130 of the float 103 until the flange 163 contacts an end surface of the second end 132. In the second position, the second end 162 of the end extension 106 extends upwardly beyond the second end 132 of the float 103, such that the height of the float assembly 101 is equal to the second distance (i.e., the distance from the second end 162 to the flange 163) plus the height of the float 103.

In a third position or shortest configuration, as shown in FIG. 5, the end extension 106 is removed from (e.g., not used with) the float 103, such that the height of the float assembly 101 is equal to the height of the float 103.

FIG. 6 illustrates an end extension 106 having a flange 164 that extends radially inward from an inner surface of the body 160, thereby defining a first distance from the flange 164 to the first end 161 and a second distance from the flange 164 to the second end 162. For example, the second end 162 of the end extension 106 is inserted over the second end 132 of the float 103 until the flange 164 contacts the end surface of the second end 132 to modify the float assembly 101 to have a first height; the first end 161 is inserted over the second end 132 until the flange 164 contacts the end surface of the second end 132 to modify the float assembly 101 to have a second height; and the end extension 106 is not used to provide the float assembly 101 with a third height.

As shown in FIG. 7, the float 103 includes a radially extending bottom 134 (i.e., a bottom wall that extends inward in a radial direction relative to the longitudinally extending outer wall 130) disposed at the first end 131. Disposed in the bottom 134 are one or more openings 135 (e.g., holes, slots, etc.), which define a flow area (e.g., a cross-sectional area that is open, such as through which water can flow). The flow area can be varied, such as discussed below, to tailor the timing of the flush cycle (e.g., by changing a buoyancy of the float). Thus, the size, shape, and/or quantity of the openings 135 can be tailored to accommodate the many different variants of toilets and flush valves used therein. The illustrated bottom 134 in FIG. 7 shows two sets of holes 135, where each set of holes 135 includes four holes having different diameters to thereby define different flow areas.

Figure 23:
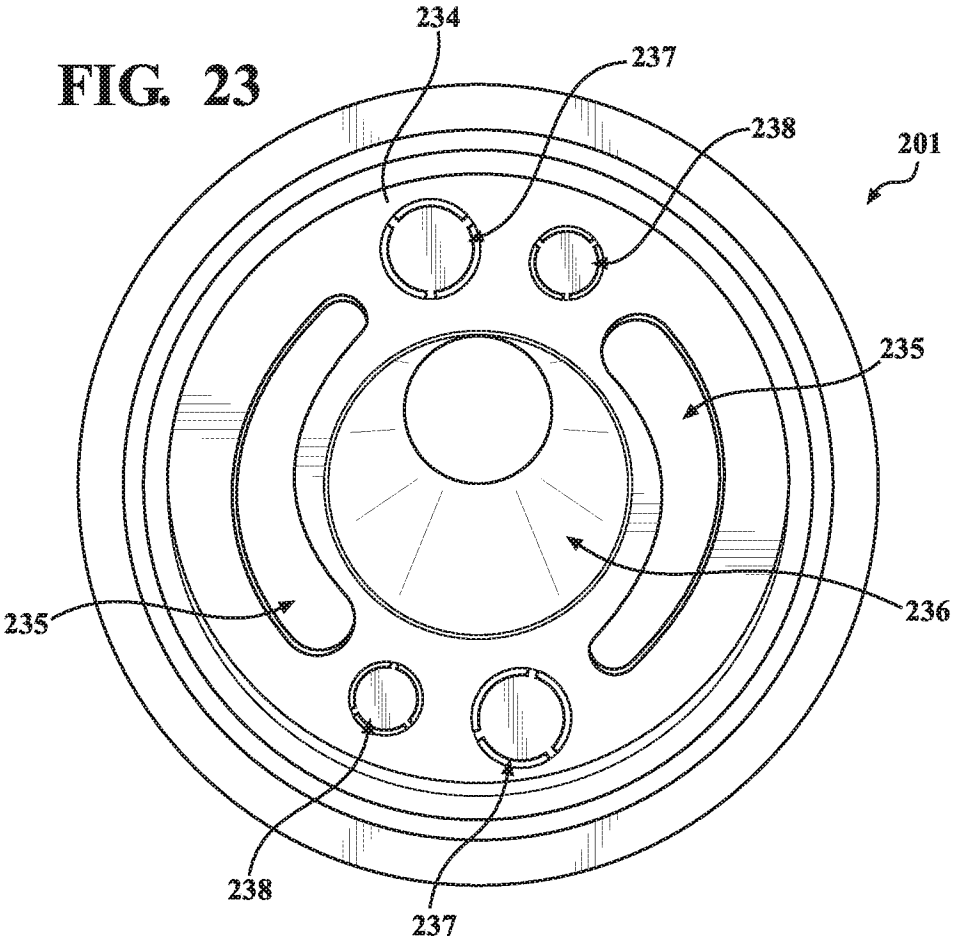
FIG. 23 is a bottom perspective view of a float for an adjustable flush valve.

As shown in FIG. 23, a bottom 234 of a float 203 is shown having two slotted openings 235 (e.g., slots) that are disposed on opposite sides of a central opening 236. The bottom 234 also includes two larger diameter openings 237 having plugs, which are formed in the bottom 234 filling most of the associated opening 237, and two smaller diameter openings 238 having plugs (e.g., tabs, knock-out tabs, etc.), which are formed in the bottom. Each plug/tab can completely fill the associated opening 237, 238 (e.g., by having perforations that do not extend fully through the thickness of the float) or can fill most of the associate opening 237, 238 (e.g., by having perforations that extend intermittently through the entire thickness of the part, similar to a stitching pattern or the like). Each plug is configured to be pushed out to increase the flow area in the bottom 234. In this way, one or more of the openings 237, 238 can be removed to tailor the flow area (e.g., increase the flow area) to predetermined requirements/performance for a specific toilet. Thus, the flow area of the float 203 can be adjusted to change the performance (e.g., timing) of the flush valve.

Figure 8:
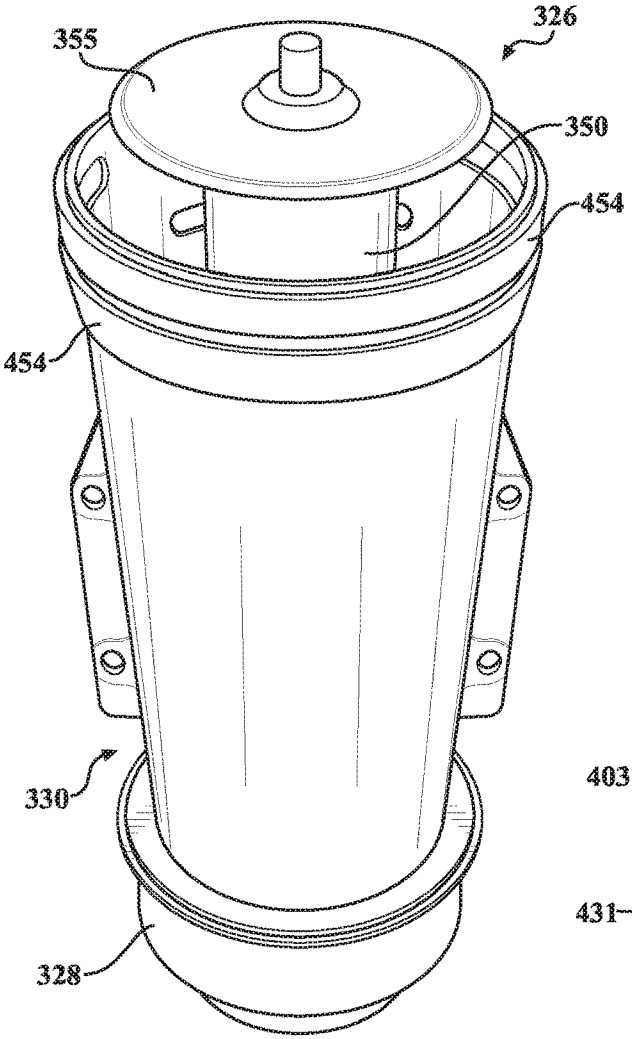
FIG. 8 is a front perspective view of an adjustable flush valve.

FIG. 8 illustrates a flush valve 326 having an adjustable flow area allowing the buoyancy of a float to be adjusted and an adjustable overflow height, such that the flush valve can be tailored to different performance characteristics/requirements of various toilets/flush valves. As shown, the flush valve 326 includes a valve body 328, a float assembly 330, a guide post 350, and a cap 355 disposed on the top of the guide post 350. The valve body 328 can be configured the same as, similar to, or different from other valve bodies (e.g., valve body 28); the guide post 350 can be configured the same as, similar to, or different from other guide posts (e.g., guide post 50); and/or the cap 355 can be configured the same as, similar to, or different from other caps (e.g., the cap having fitting 55 shown in FIG. 2).

FIGS. 9-21 illustrate the float assembly 330 having an adjustable flow area and overflow height, such that these performance characteristics of the float assembly 330 can be tailored to different toilets/flush valves. The illustrated float assembly 330 includes a float 403 and a disc 406 (FIG. 14) that is operably coupled to the float 403 so that the disc 406 is selectively rotatable about a pivot axis PA, which may be concentric with the longitudinal axis, relative to the float 403 into any one of a plurality of positions (e.g., sixteen positions shown in FIG. 13), where each position corresponds to a different performance (e.g., flow area, buoyancy, etc.) provided by the float assembly 330.

Figure 12:
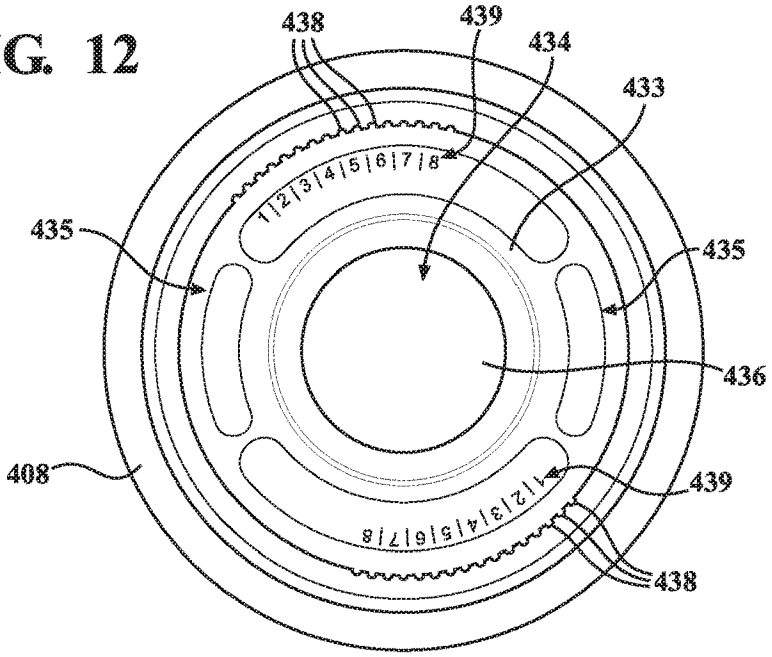
FIG. 12 is a bottom view of the adjustable float shown in FIG. 9 without a disc.
Figure 11:
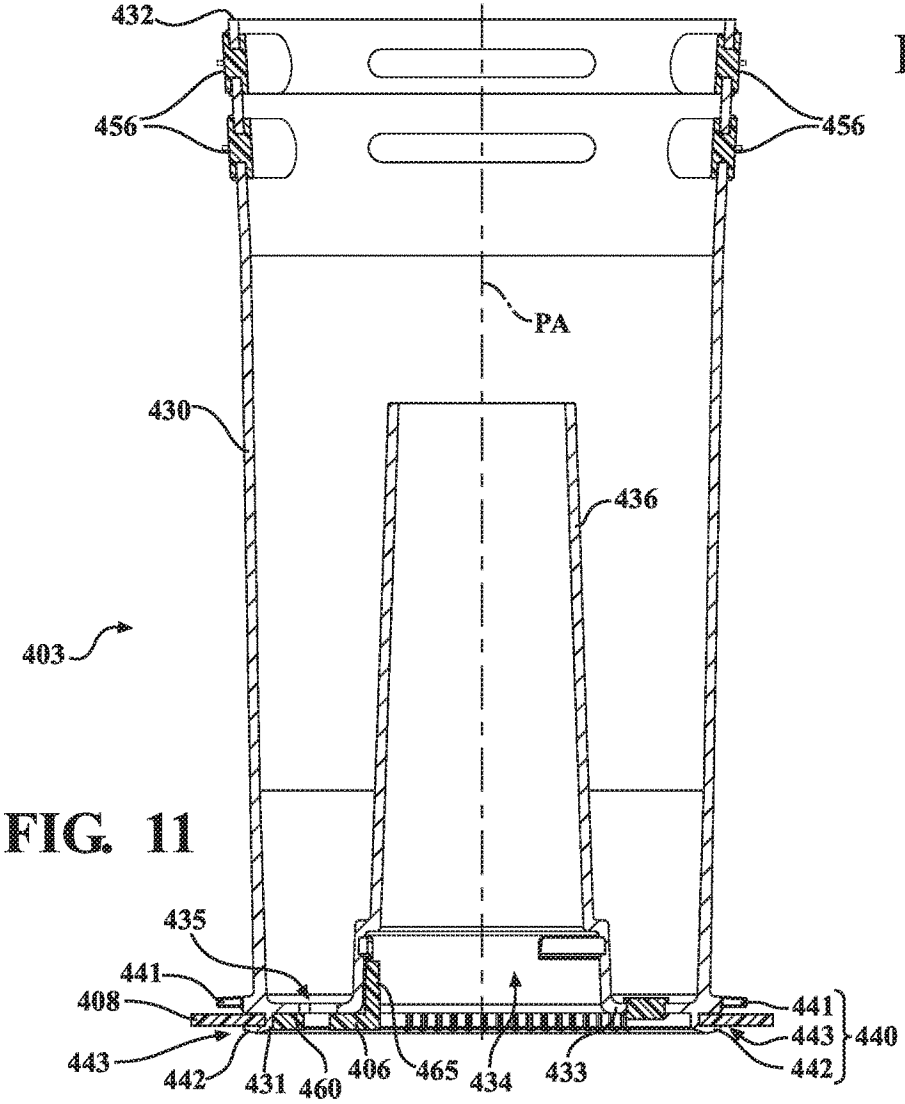
FIG. 11 is a side cross-sectional view of an adjustable float for a flush valve.
Figure 18:
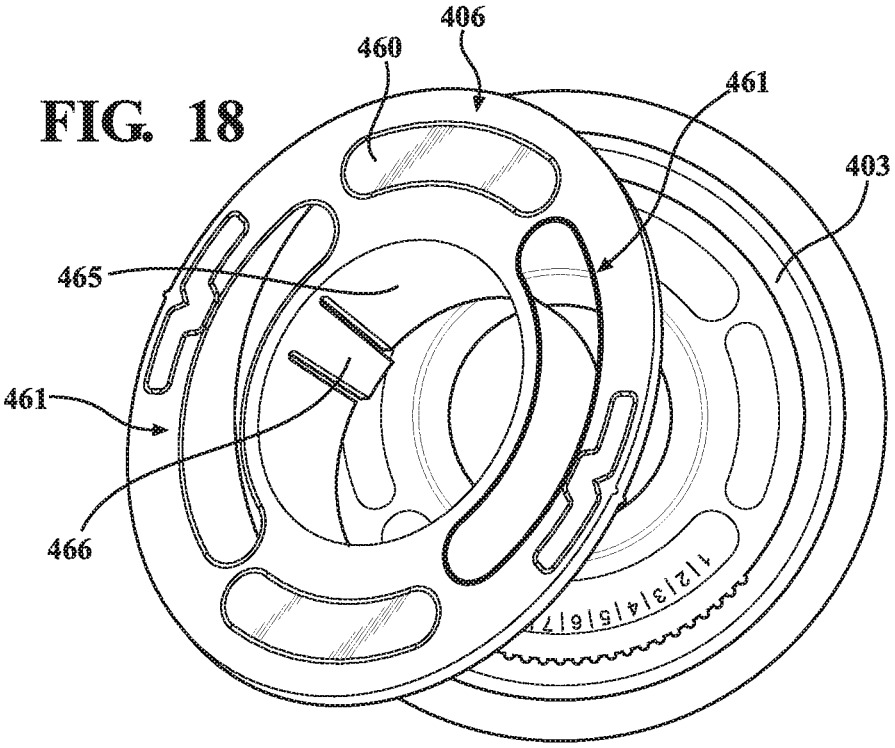
FIG. 18 is a perspective view showing the disc being assembled to the float shown in FIG. 14.

The illustrated float 403 has a longitudinally extending outer wall 430 (e.g., cylindrical wall) extending between a first or lower end 431 and a second or upper end 432. The float 403 has a bottom 433 extending radially inward from an inside of the outer wall 430. That is, the bottom 433 extends inward in a radial direction relative to the longitudinally extending outer wall 430. The bottom 433 is shown in FIG. 11 disposed proximate or closer to the lower end 431. As shown in FIG. 12, disposed in the bottom 433 around a central opening 434, which is configured to receive the guide post 350, are two elongated semi-circular (e.g., arcuate, angularly slotted, etc.) openings 435, which together define a flow area of the float 403. That is, each opening 435 is shown as being elongated or slotted along a length that is part of a circumference at a given radius from the pivot axis PA. The illustrated float 403 includes an inner wall 436 that extends generally upward (e.g., vertically or at an angle to vertical) from an inner end (e.g., diametrically) of the bottom 433 toward the top or upper end 432 of the float 403. The inner wall 436 can be configured to move along a guide post or member (e.g., guide post 50, 250) during movement of the float 403, such as during flush cycles. The inner wall 436 is shown in FIG. 11 as having a tapered (e.g., frusto-conical) shape moving from bottom to top, but the inner wall 436 can have other shapes (e.g., cylindrical).

Figure 13:
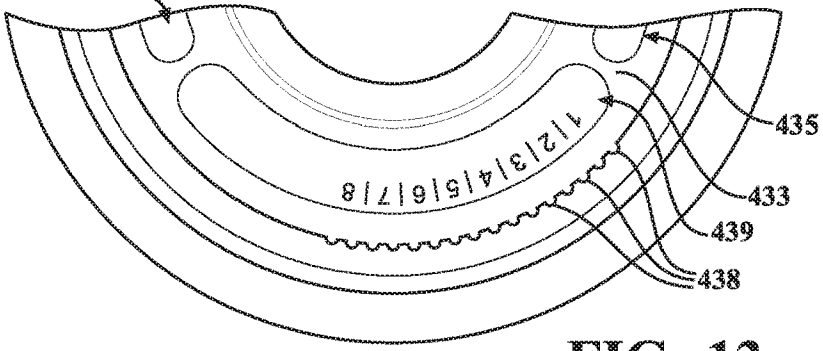
FIG. 13 is a detail view of a portion of the float shown in FIG. 12.
Figure 28:
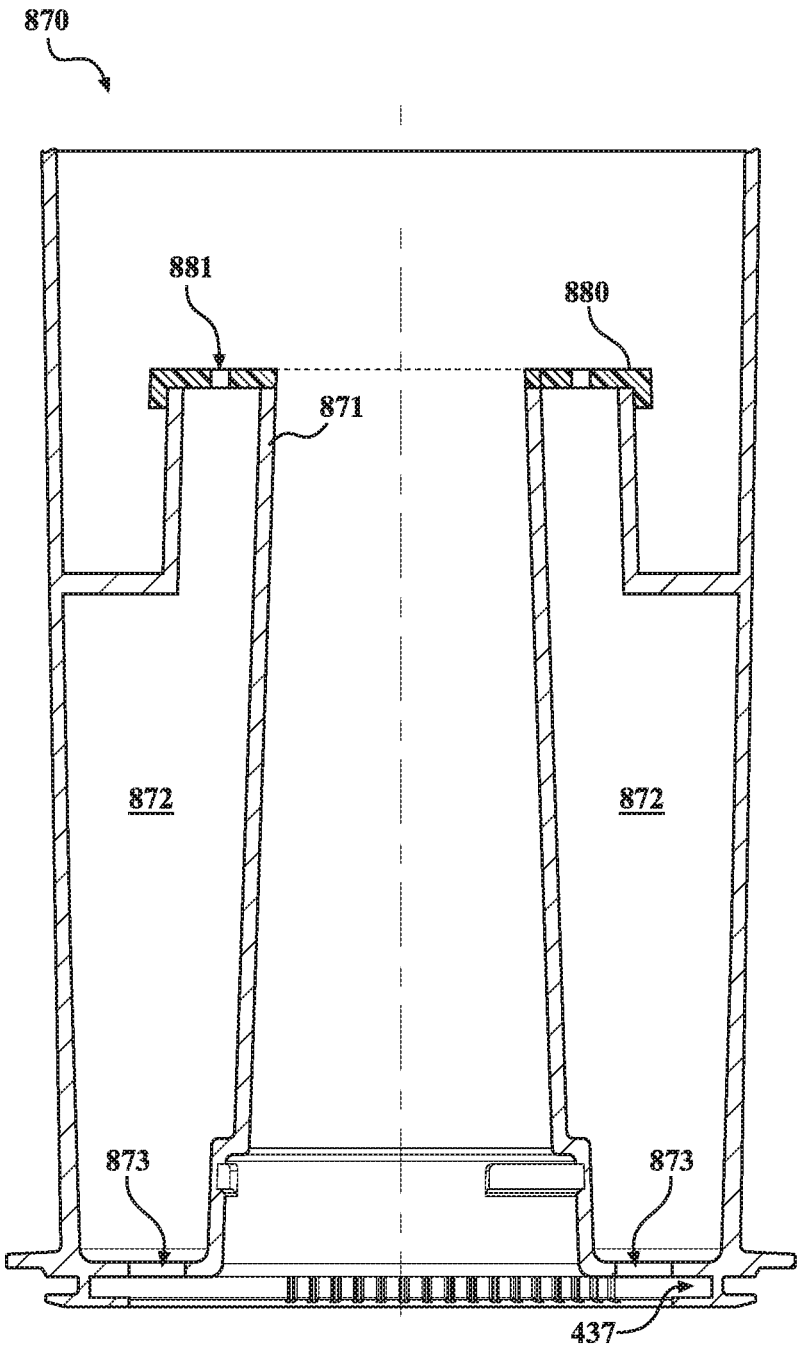
FIG. 28 is a cross-sectional view of the float shown in FIG. 27.

Also shown in FIG. 11, the disc 406 is disposed underneath the bottom 433, with a body (e.g., body 460) of the disc 406 adjacent to and generally parallel to the bottom 433 and with a shoulder (e.g., shoulder 465) of the disc 406 extending into a bore defined by the inner wall 436. As shown in FIG. 28, the disc 406 is configurable to have an outer periphery of the body of the disc 406 received in a recess 437, which can be in an inner surface of the outer wall 430 and below the bottom 433. The recess 437 can be undercut to secure the body of the disc 406 in place relative to the float. For example, the disc 406 can be configured to snap into the recess 437, such that the disc 406 is retained by the float 403 in a longitudinal direction, yet the disc 406 is rotatable relative to the float 403 about the pivot axis PA to change the position of the disc 406. The outer periphery of the disc 406 and the inner surface defining the recess may be smooth, or may include teeth, such as ratchet teeth allowing rotation of the disc 406 relative to the float 403 in one direction. As shown in FIGS. 12 and 13, the float 403 includes first and second pluralities of teeth 438 provided on opposite sides of the inner surface (e.g., in the recess 437) between the bottom 433 and the first end 431, wherein the teeth 438 are configured to engage a mating tooth 464 or teeth of the disc 406. Each tooth of each plurality of teeth 438 can correspond to one relative position between the disc 406 and the float 403, and optional markings 439 (e.g., 1, 2, 3, 4, etc.) can be provided on the float 403 identifying the various relative positions. The illustrated markings 439 include numerals 1-8 with a slash provided between each adjacent pair of integers to denote half-positions. It is noted that the number of markings and the specific markings utilized can be different than shown. If provided, the teeth 438, 464 help retain the disc 406 in a given position relative to the float 403 while allowing the disc 406 to rotate (e.g., clockwise, counterclockwise) relative to the float 403 to reposition the disc 406.

Figure 19:
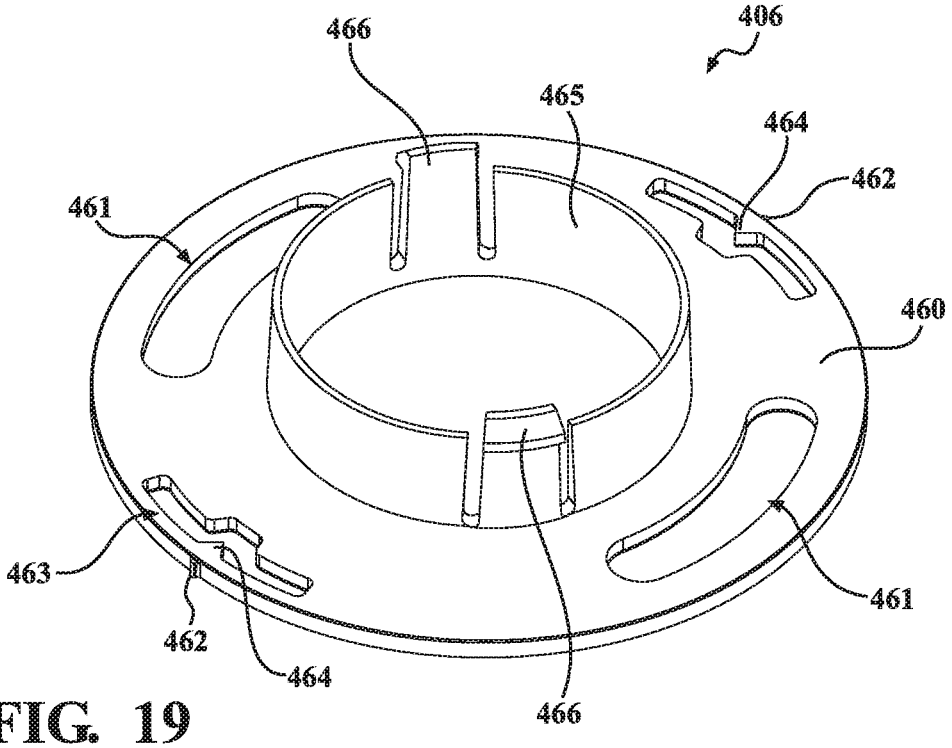
FIG. 19 is a perspective view of the disc shown in FIG. 18.
Figure 20:
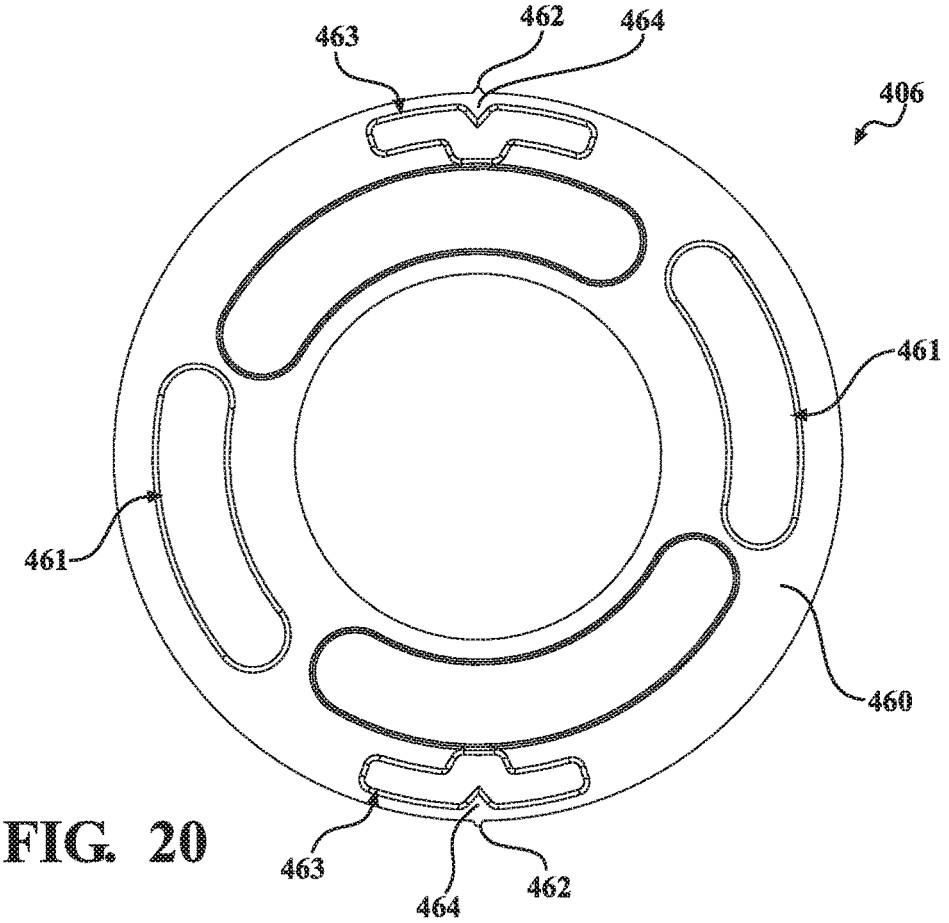
FIG. 20 is a bottom view of the disc shown in FIG. 18.
Figure 21:
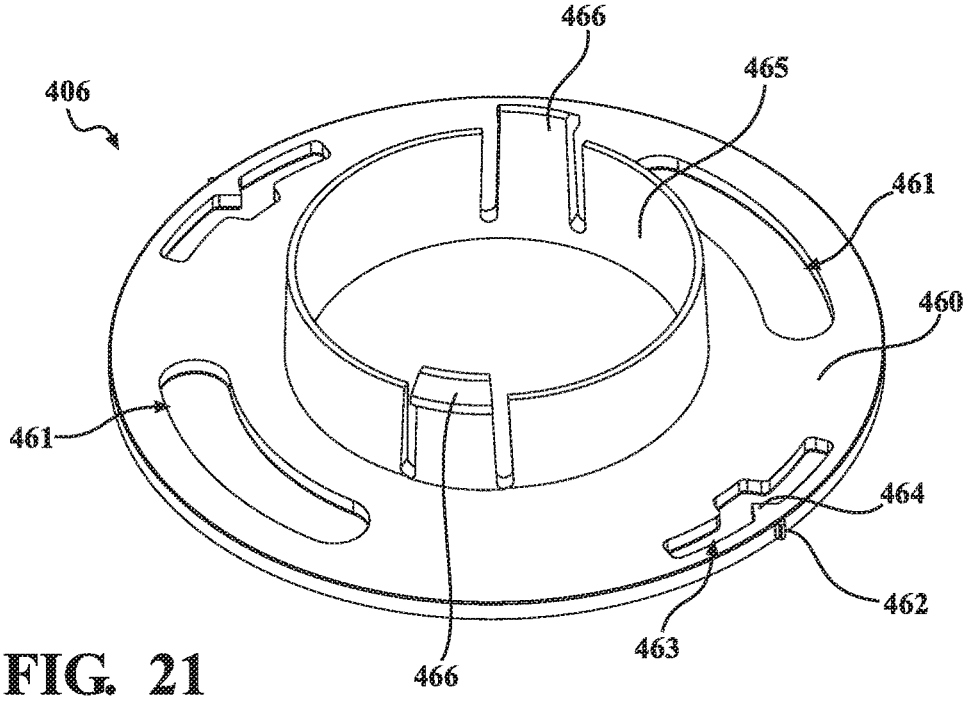
FIG. 21 is another perspective view of the disc shown in FIG. 18.

The disc 406 includes one or more ports that are configured to permit fluid (e.g., water) flow through. As shown in FIGS. 19-21, disposed in a body 460 of the disc 406 are two elongated semi-circular ports 461 (e.g., slots, openings, etc.), although each port can have any suitable shape and/or size that can be tailored to be used universally with the multitude of valves/toilets. The illustrated elongated semi-circular ports 461 slots are located on opposite sides of the body 460 relative to the pivot axis and are configured at a substantially common radius from the pivot axis or longitudinal axis of the float 403 as the openings 435 therein. The pivot axis PA of the disc 406 can be concentric with the longitudinal axis of the float 403, as shown, or can be offset. Relative rotation between the disc 406 and the float 403 (i.e., rotating the disc relative to the float, rotating the float relative to the disc) is configured to change the positions of the ports 461 in the disc 406 relative to the openings 435 in the float 403 (e.g., to change the overlapping surface area between the ports 461 and openings 435) to change the flow area. A larger overlapping surface area increases the flow area, whereas a smaller overlapping surface area reduces the flow area. FIGS. 14-16 illustrate various degrees of such overlapping. FIG. 15 shows a fully closed or no overlapping position between the disc 406 and the float 403, in which there is no overlap between the ports 461 and the openings 435, since the ports 461 overlap with a solid portion of the bottom 433 of the float 403. FIG. 16 shows a fully open or full overlapping position between the disc 406 and the float 403, in which each port 461 overlaps completely with the associated opening 435 so that water can flow through the whole port 461/opening 435. FIG. 14 shows an intermediate position between the fully closed (FIG. 15) and fully open (FIG. 16) positions, and in the intermediate position a portion of each port 461 overlaps with a portion of each associated opening 435, such that water can flow through the overlapping area(s).

Also shown in FIGS. 19-21, the body 460 of the disc 406 includes a tooth 462 associated with each plurality of teeth 438 of the float 403. Each tooth 462 extends radially outward from an outer profile of the body 460 to engage (e.g., mate) with the teeth 438. Provided radially inward from the tooth 462 in the body 460 is an opening 463 that is configured (e.g., size, location, etc.) to overly a marking 439 to denote the relative position between the disc 406 and the float 403. Thus, the opening 463 overlies the marking "2" when in the second position. A second tooth 464 can be provided to point into the opening 463 (i.e., opposite or away from the tooth 462) and toward the marking to further highlight the relative position between the disc 406 and the float 403. The number of positions that the disc 406 can be rotated into (relative to the float 403) can be tailored, and in each position, the float assembly 330 can be configured to provide a different buoyancy or flow rate by having a predetermined flow area associated with each position. As shown in FIG. 13, the disc 406 can be rotated into sixteen discreet positions corresponding to sixteen different buoyancies or flow rates. The markings 439 can be visible, such as from above or below the assembly (prior to or after assembly), where the markings 439 identify the position (i.e., buoyancy, flow rate, etc.) the assembly is configured in. It is noted that additional discreet positions can be provided between the base markings (e.g., 1, 2, etc.) and can be identified by sub-markings (e.g., dashes, dots, letters, etc.) in the instance where the float assembly 330 has additional positions between the base markings. By way of example, the float assembly 330 can provide a set number (e.g., 2, 5, 10, etc.) of additional positions between each pair of positions corresponding to the base markings. Alternatively, no intermediate or sub-markings have to provided, as the float assembly can provide the number (e.g., 8) of positions identified by the primary markings. In this way, the assembly can provide any number of different positions corresponding to any number of different buoyancies/flow rates, which influence the timing of the flush cycle.

As shown best in FIGS. 19 and 21, the disc 406 includes an annular shoulder 465 extending longitudinally (e.g., transverse to radial direction) from the body 460. The annular shoulder 465 is configured to engage the central opening 434 in the float 403. Also shown, the annular shoulder 465 includes two snap-features 466 provided on opposite sides of the shoulder to help couple the disc 406 to the float 403. Each snap-feature 466 is configured as a cantilevered tab extending away from the body 460 with a detent at the distal end of the tab for engaging a recess or undercut feature in the float 403. As shown, each side of each snap-feature 466 is disconnected or separated from the shoulder 465 by a gap.

Also shown best in FIGS. 11-14, a seal 408 is carried in a recessed pocket 440 of the float 403 and is configured to selectively seal against a valve seat of a valve body in a closed position. The illustrated seal 408 is annular in shape and extends around a portion of the lower end 431 of the float 403. The recessed pocket 440 is defined by an upper flange 441 and a lower flange 442 extending radially outward from a recess 443 disposed between the flanges 441, 442.

Figure 10:
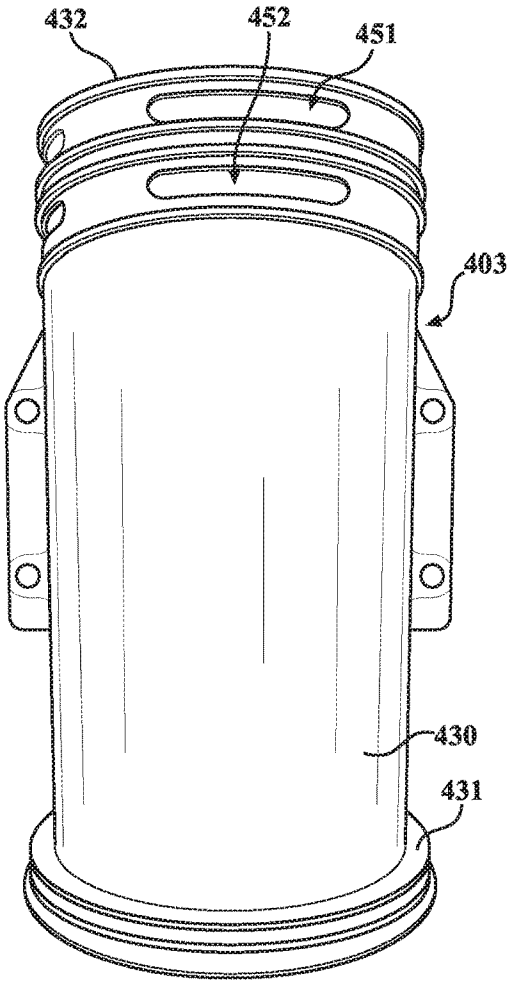
FIG. 10 is a front perspective view of an adjustable float for the adjustable flush valve shown in FIG. 8, with the bands removed showing the openings.
Figure 9:
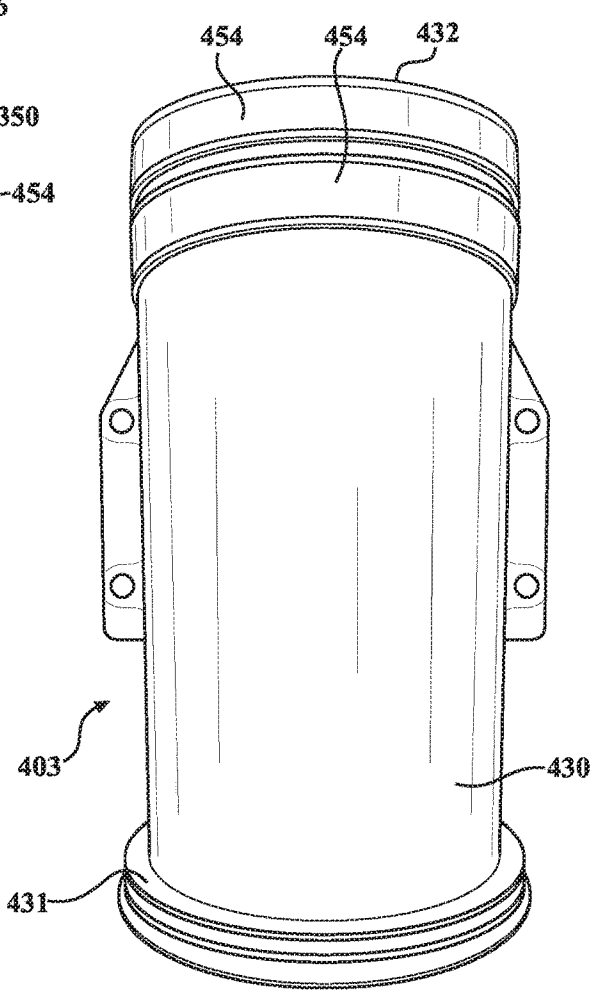
FIG. 9 is a front perspective view of an adjustable float for the adjustable flush valve shown in FIG. 8, with bands covering openings.

FIGS. 8-10 show that the float 403 can be configured to provide different overflow characteristics (e.g., overflow height, overflow rate, etc.) for the flush valve having the float 403. As shown in FIG. 10, the outer wall 430 of the float 403 has a first opening 451, which is proximate the upper end 432, and a second opening 452, which is located below the first opening 451 by an offset distance. Thus, the first opening 451 is located at a first height (e.g., relative to the upper end 432, a bottom of the tank, an overfill line, etc.), and the second opening 452 is located at a second height, which is different than the first height, so that the different openings 451, 452 are able to provide different overflow heights. Each opening 451, 452 is shown to be slotted circumferentially (rather than longitudinally) or having an elongated width (i.e., a width that is larger than the height), although the shape and size of each hole can be different than what is shown. Further, the float can have additional first openings and/or second openings located around the float at different radial positions while corresponding to the same relative height as the associated opening(s).

Each opening 451, 452 or set of openings (e.g., all first openings, all second openings) can be covered or left uncovered to tailor the overflow height. As shown in FIGS. 8 and 9, an annular band 454 can be detachably coupled to a section of float 403 having the opening 451 and/or the opening 452. FIGS. 8 and 9 show two annular bands 454, with a first band 454 wrapping around and covering the section having the first opening(s) 451, and with a second band 454 wrapping around and covering the section having the second opening(s) 452. In this arrangement, the overflow height of the valve having the float 403 would be defined by the top edge of the upper end 432. By removing the upper or first band 454 and uncovering the first opening(s) 451, the overflow height would be adjusted to and defined by the height of the first opening(s) 451. By removing the lower or second band 454 and uncovering the second opening(s) 452, the overflow height would be adjusted to and defined by the height of the second opening(s) 452. In this way, the flush valve 326 can be configured to universally fit toilets having any one of the three overflow heights. Moreover, each float (e.g., float 403) can be configured having additional openings at different heights from the first and second openings 451, 452 to provide additional overflow heights. For example, a float can have a third opening offset downwardly from the second opening, a fourth opening offset downwardly from the third opening, and so forth if necessary. Additional holes can be located in the float to provide additional adjustability of the overflow height, such that a single float (e.g., float 403) can be used universally to provide any number of different overflow heights to accommodate any number of different toilet designs.

Each annular band 454 can be made from an elastic material and sized to stretch over the circumference of the float 403 at the section having the associated opening (e.g., openings 451, 452, etc.). Thus, each band 454 can cover the one or more than one opening at each height level at the same time. Further, each band 454 can easily be removed from or placed over the associated opening without the need of tools or professional installers.

According to other examples, each opening (e.g., openings 451, 452, etc.) can be filed with an associated plug, which can complement the shape and size of the associated hole to prevent the flow of water through the plugged hole. As shown in FIG. 11, a plug 456 can extend through the opening and have a flange on one or both sides of the wall of the float 403 (e.g., a first flange on the inside, a second flange on the outside) to secure the plug 456 with an interference fit with the float 403. Each flange can extend outward from a central portion of the plug 456 that engages the respective opening 451, 452. The overflow height and the overflow rate of the float 403 can be tailored by plugging one or more specific openings (e.g., openings 451, 452, etc.) and leaving one or more specific openings unplugged. For example, a lower overflow height can be achieved by leaving one or more of the lower or second openings 452 unplugged, and the overflow rate will be higher if two (or more) openings 452 are unplugged compared to only one opening 452 being unplugged. Also, for example, a higher overflow height can be achieved by plugging all of the lower or second openings 452 and leaving one or more of the upper or first openings 451 unplugged. Again, the float 403 can include multiple first openings 451 and by plugging a fewer number of them, a relative higher flow rate can be achieved. The number, size, shape, and location of the holes 451, 452 can be changed to tailor the performance characteristics of the float 403. Again, each plug 456 can easily be removed from or placed into the associated opening without the need of tools or professional installers.

Figure 22:
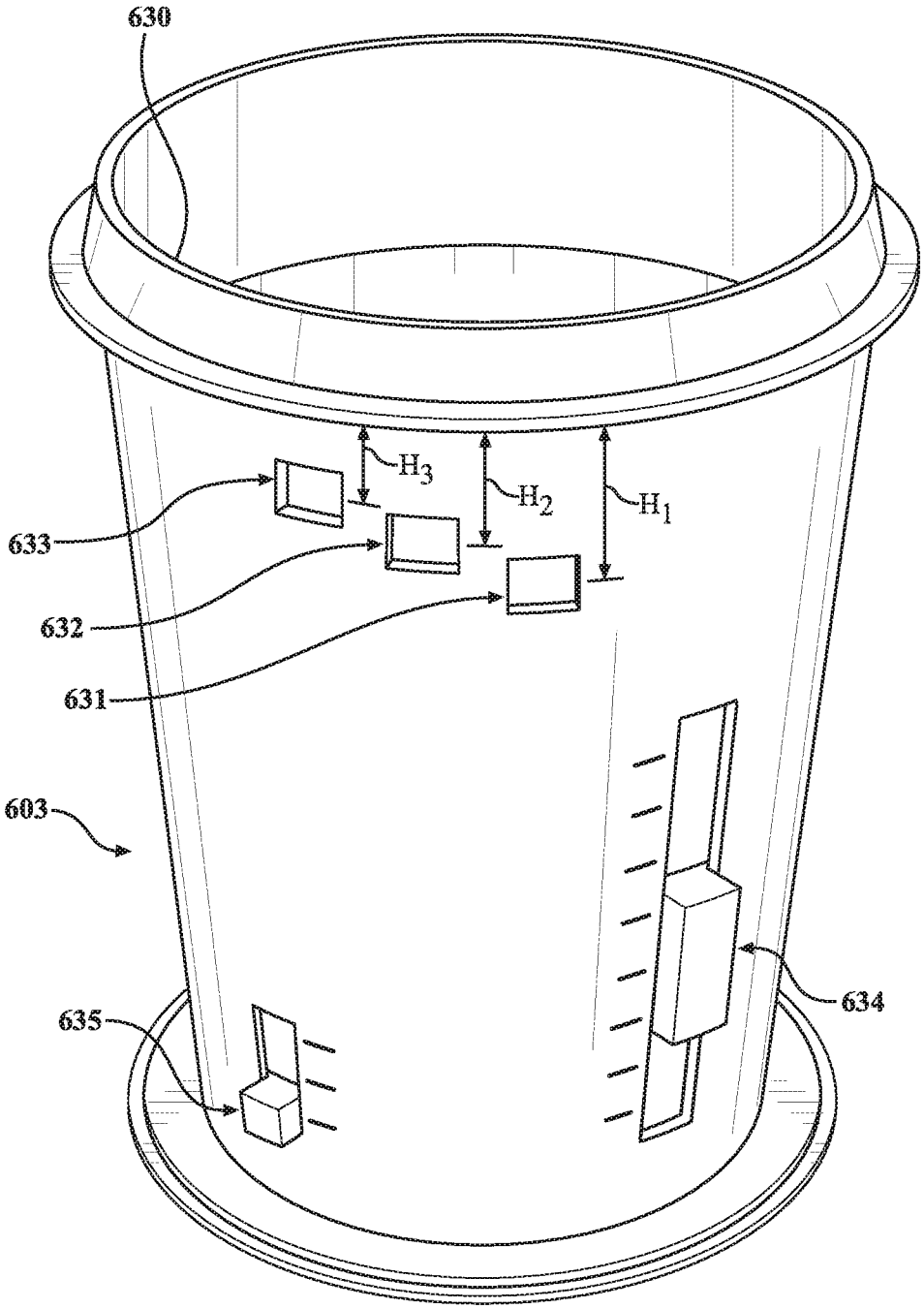
FIG. 22 is a perspective view of a float for an adjustable flush valve.

FIG. 22 illustrates a float 603 for a canister flush valve. The float 603 has an outer wall 630 with one or more overflow openings (e.g. holes) disposed at one or more different heights (e.g., distances from the top of the float). As shown, a first opening 631 is provided at a first height H1, a second opening 632 is provided at a second height H2, and a third opening 633 is provided at a third height H3, so that the canister flush valve employing the float 603 can provide three different overflow heights, such as by adjusting which of the holes are plugged/unplugged. The illustrated float 603 also includes an adjustable switch 634, 635 that is movable relative to the float 603 to adjust the buoyancy of the float 603 to influence the timing of the flush provided by the canister flush valve employing the float 603. For example, at least one switch 634, 635 can be configured to rotate a disc, such as the disc 406, between one or more positions, with each position corresponding to a different buoyancy or timing. Alternative to or in combination with adjusting buoyance, a switch 663, 635 can be configured to provide a dual flush control the flush valve/toilet.

An alternative to the embodiments employing openings/holes that are configured to receive separate plugs is to replace the openings/holes with solid elements (e.g., integral plugs, tabs, etc.) that are detachable (i.e., can be "knocked out") from the flush valve (e.g., the float) to create one or more openings/holes, such as shown in FIG. 23. For example, an outer wall of a flush valve can include one or more sections/locations configured having partial perforations (e.g., perforations that do not extend all the way through the thickness of the wall but a portion of the thickness), or intermittent full perforations, such that the sections can be removed to form a hole that sets the overflow height of the flush valve. In this way, plugs do not need to be placed into the openings/holes to tailor buoyancy and/or overflow height, since the plugs can be formed with the float, which can save time and cost.

Another alternative to the embodiments, a snap cover (e.g., push plug) can be utilized with each hole in the float, where each snap cover is movable in and out between closed and open positions. In the closed position, water is prevented from flowing through an opening associated with (e.g., covered by) the snap cover. In the open position, water can freely flow the associated opening.

Figure 24:
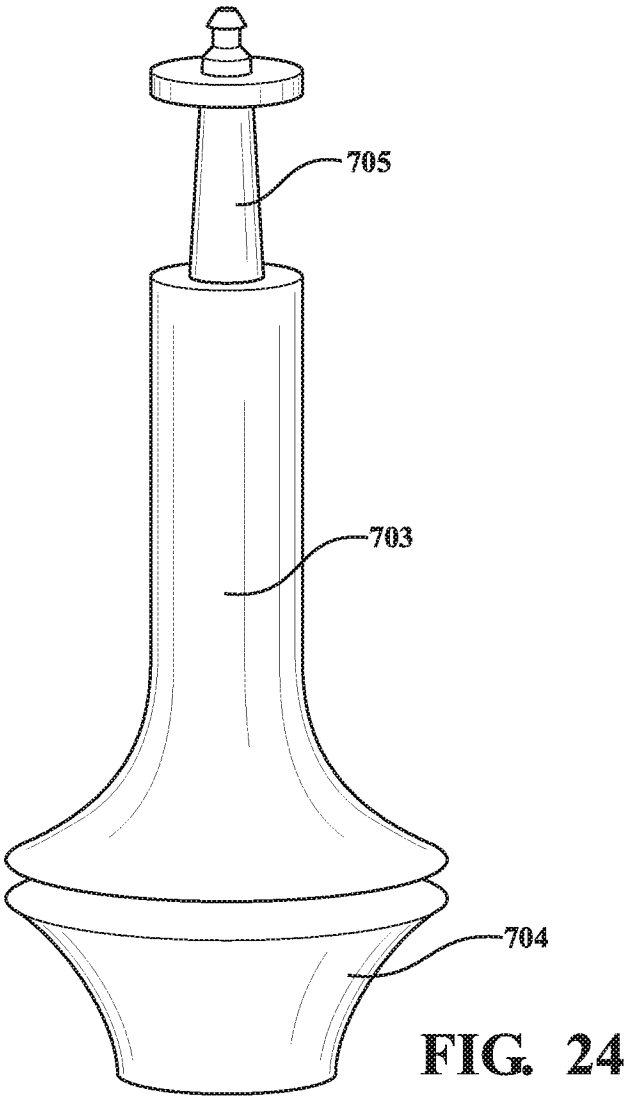
FIG. 24 is a plan view of an alternative shaped canister float for a valve.

FIG. 24 illustrates a canister float 703 for a valve having an alternative shape. The overall profile of the canister could be designed to be a multitude of shapes and sizes while maintaining the proper buoyancy properties. Although the float 703 is narrow at the top and transitions (e.g., via a curved surface) into a larger bottom, a float used herein can be, for example, hourglass shaped, mushroom shaped, round at the bottom, square at the top, taper from large at the bottom to small at the top, or any combination of the above. The specific shapes may be tailored to aid manufacturing, cost less (e.g., by using less material), and/or enable other features (e.g., like an adjustable bleed hole on top to adjust buoyancy). The float 703 can movably couple to a guide post 705 to selectively seal with a valve body 704, such as in the manners described herein with other embodiments.

Figure 25:
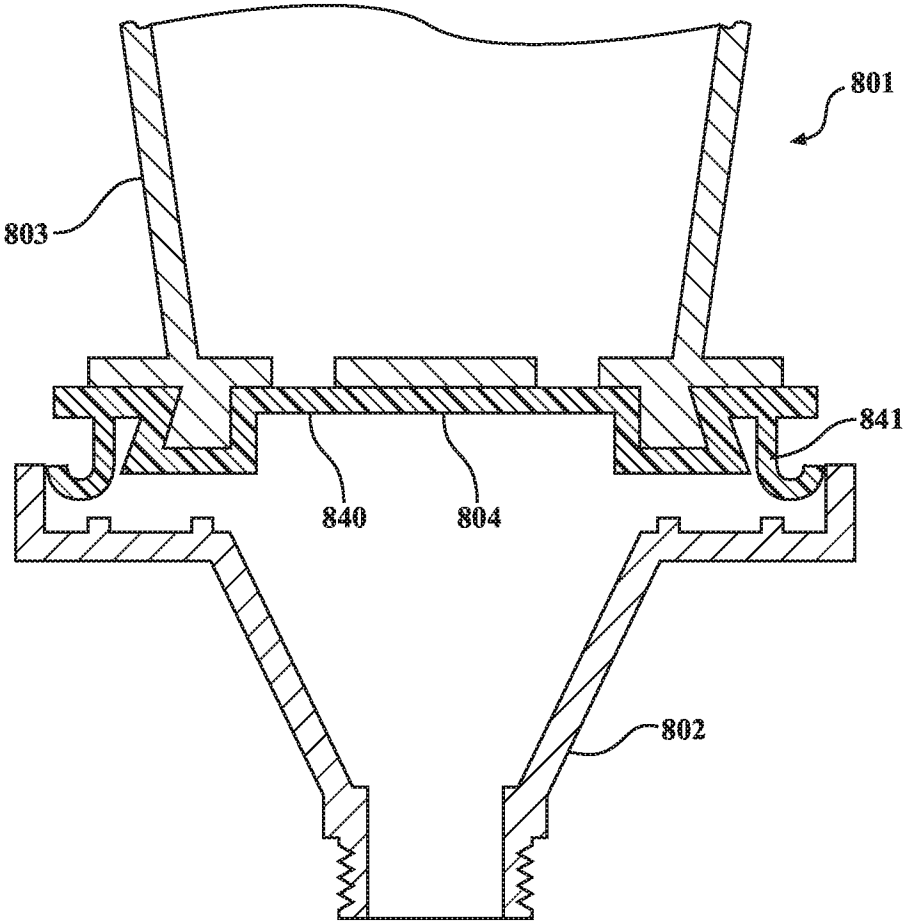
FIG. 25 is a cross-sectional view of a float assembly having an integrated flexible disc and seal.

FIG. 25 illustrates a float assembly 801 having a valve body 802, a float 803, and an integrated flexible disc and seal 804 that is shown carried by a bottom of the float 803 and configured to seal to the valve body 802 in a closed position. The integrated flexible disc and seal 804 includes a disc portion 840, which is rotatable relative to the float 803 (e.g., the same as or similar to the disc 406) to control buoyancy/timing (e.g., by providing an adjustable flow area), and a sealing member 841 that seats against the valve body 802 in the closed position to form a seal and unseats from the valve body 802 in an open position to allow water to flow between the sealing member 841 and a valve seat on the valve body 802. The integrated flexible disc and seal 804 can be formed from the same material, or the disc portion 840 and the sealing member 841 can be formed from different materials. For example, the disc portion 840 can be formed to be rigid, such as using a material like a hard-plastic (e.g., acrylonitrile butadiene styrene or ABS), while the sealing member 841 can be flexible, such as using a material like a silicone or an elastomer. Where the dial is encapsulated by the bottom edges of the canister, a flexible dial could also be designed to extend out and around the outside perimeter of the canister, and can be molded to match the canister design to create a water tight seal. The flexible dial could also be designed to incorporate the primary valve seal that is a separate part.

Figure 26:
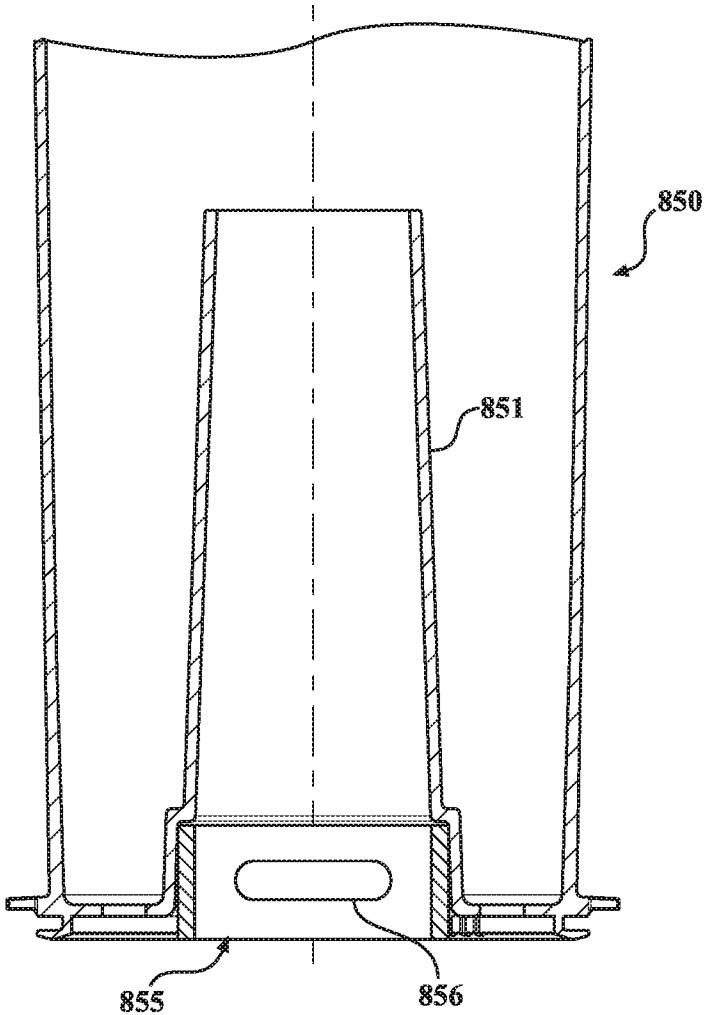
FIG. 26 is a cross-sectional view of another float.

FIG. 26 illustrates a float 850 having an inner tube 851 (e.g., overflow tube) that receives a disc 855, which can be rotatably coupled to an inside of the inner tube 851. Relative rotation changes the alignment between one or more slots 856 in the disc 855 and one or more slots in the inner tube 851 to change the size of openings to control buoyancy. The slots in the dial and canister that can be adjusted (e.g., opened and closed) to change buoyancy could be placed internally along the inside shaft of the float in addition to or in place of the slots in the bottom of the float, such as discussed in other floats herein. The disc 855 could extend upward inside the shaft to control the size of the openings.

Other design aspects of the (canister) flush valves can be used to control function. For example, sealed top and/or donut shaped floats can be used to trap air as part of the buoyancy timing. The trapped air could be either static or dynamic. The trapped air could be continuously held inside the valve continuously or released with each flush in a metered or unmetered fashion. Instead of a disc/dial on the bottom of the valve, a dial could be located on top of (or above) the water level in the tank. An opening size could be adjusted by a multitude of hole sizes/shapes, overlapping openings, doors, etc. Also, for example, a larger or smaller flange can be provided around the bottom of the canister, such as to change/affect how much force it takes to remain sealed to the base and released from the base or flushed. Also, for example, the slots could be holes or an opening of any shape and/or size. Any of the openings (e.g., openings in bottom, openings in top, etc.) could be designed as knock-outs, in addition to holes/openings with plugs, or openings with a sliding window or dial. The overflow openings on the top could be designed to work with one larger band that slides up and down to seal the openings.

Figure 27:
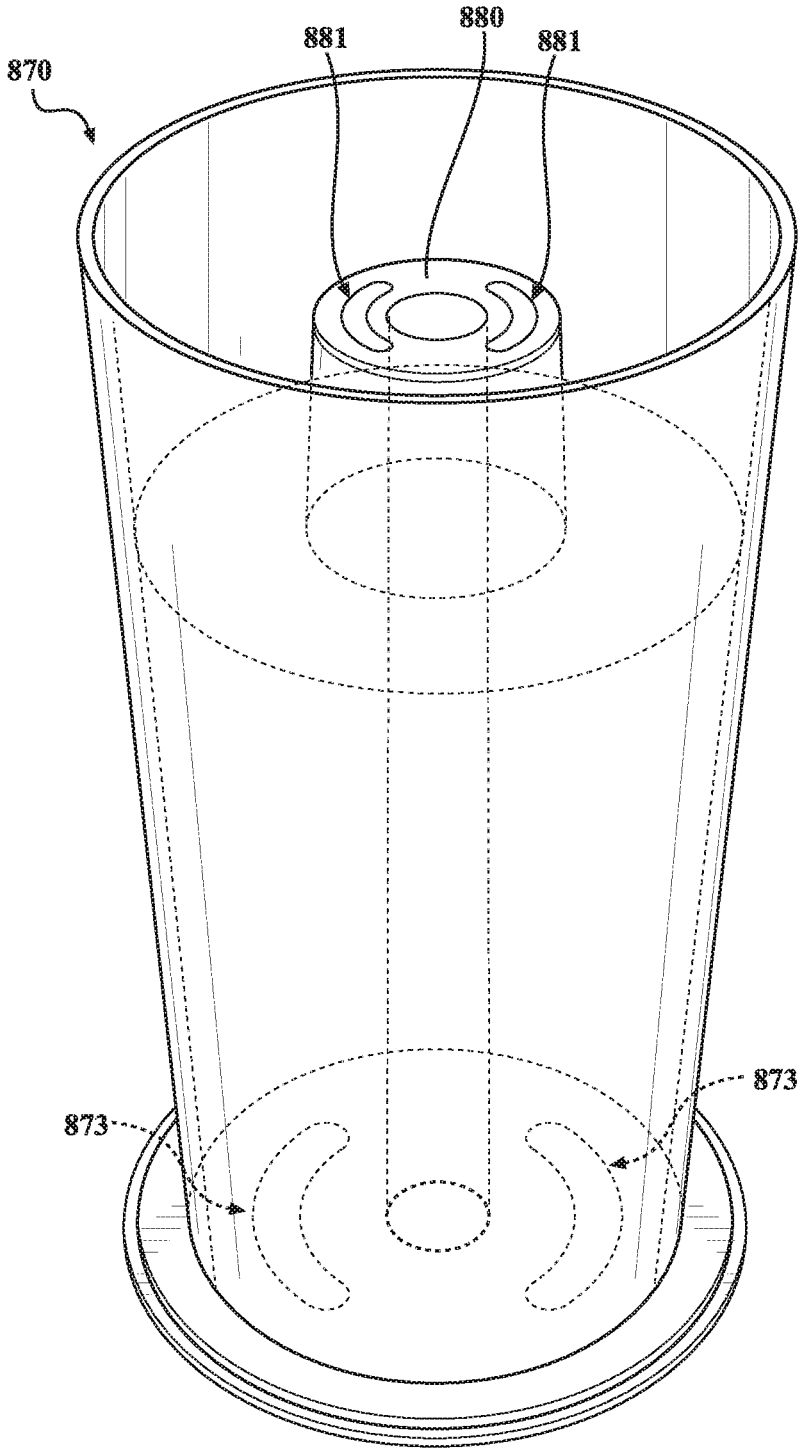
FIG. 27 is a perspective view of yet another float.

FIGS. 27 and 28 illustrate an embodiment of a float 870 for use with a valve that is configured to control the exit of air (e.g., instead of the entrance of water) through openings in the float 870. As shown, an adjustable rotating dial/disc 880 is disposed on top of a central portion 871 of the float 870, such that relative rotation changes the size of adjustable air bleed holes 881 to influence (e.g., increase, decrease) airflow from one or more air chambers in the float 870. For example, the holes 881 can rotate relative to holes/ports in the float 870 to adjust an overlapping surface area between the holes to change the surface area through which airflow takes place. Water openings 873 (e.g., slotted openings, circular openings, etc.) can be disposed in the bottom of the float 870 to allow water to flow into the air chamber(s) as air is released from the air chamber(s). It is noted that a rotating disc/dial can, optionally, be employed with the float 870 to control the size of the water openings.

Figure 30:
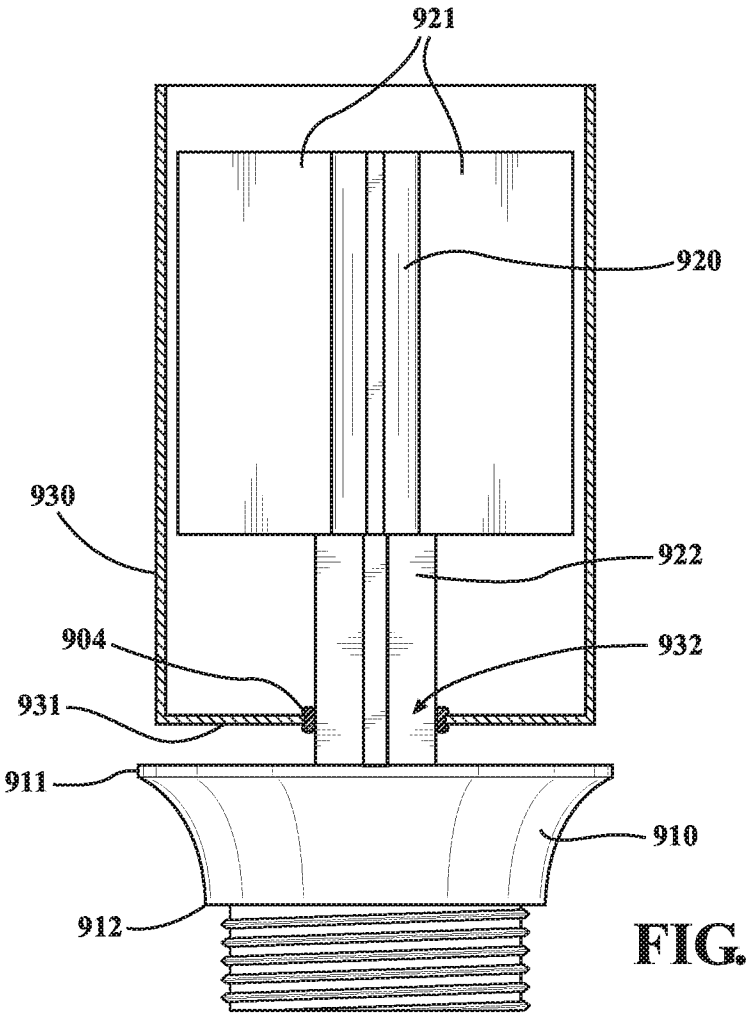
FIG. 30 is a partial cross-sectional view of the flush valve of FIG. 29.
Figure 29:
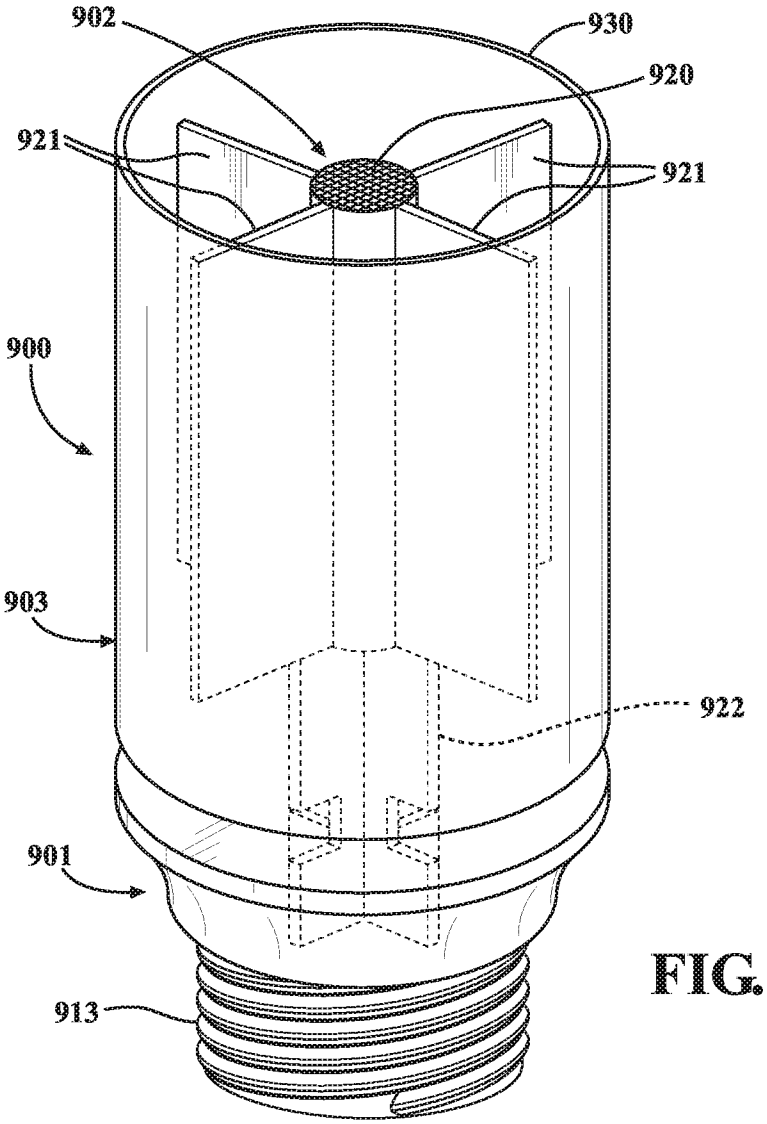
FIG. 29 is a perspective view of a flush valve having a single wall float.

FIGS. 29 and 30 illustrate an embodiment of a flush valve 900 that includes a valve body 901, a guide post 902, and a float 903. The valve body 901 is configurable according to any other valve bodies disclosed herein or otherwise. The illustrated valve body 901 includes an outer wall 910 extending between an upper or first end 911 and a lower or second end 912. Extending from the second end 912 is a threaded portion 913 that threads to another component, such as a valve nut, to secure the valve body 901 in place, such as to a toilet tank. The valve body 901 is hollow to pass water therethrough, such as flush water from a toilet tank to a toilet bowl during a flush cycle of a toilet.

The guide post 902 is configurable according to any other guide posts disclosed herein or otherwise. The illustrated guide post 902 includes a central body 920, which is shown in FIG. 29 as having a hollow cylindrical shape although the body 920 can have other shapes, with a plurality of flutes 921 extending radially outward from different locations of the central body 920. The body 920 is hollow to allow refill water to pass through the body 920. Although four flutes 921 are shown at approximately 90° spacing from one another, the guide post 902 can have fewer or additional flutes 921, which can be aligned at angles other than 90° or different angles altogether. A lower leg 922 extends downwardly from the central body 920 to attach to a portion of the valve body 901 to secure the guide post 902 to the valve body 901. Although the lower leg 922 is shown as having a cross shape, the lower leg 922 can have other shapes.

The float 903 has a single wall, shown as an outer wall 930 having an annular shape in FIG. 29, although the outer wall 930 can have other shapes. As shown in FIG. 30, the float 903 has a bottom or bottom wall 931 extending radially inward from the outer wall 930 to form a cup shaped float 903. Although the bottom wall 931 extends from a bottom of the outer wall 930 in FIG. 30, the bottom wall 931 can extend from other portions of the outer wall 930. The bottom wall 931 includes an opening 932 configured to receive the guide post 902 to allow the float 903 to move relative to the guide post 902. For example, the shape of the opening 932 can complement the shape of the guide post 902 (e.g., cross shape). Optionally, a seal 904 can be provided between the guide post 902 and the float 903. FIG. 30 shows an inner periphery of the bottom wall 931 carrying the seal 904, such that the seal 904 moves with the float 903 relative to the guide post 902. The bottom wall 931 can include other holes or openings, such as discussed herein. For example, openings in the bottom wall 931 can cooperate with ports in a disc to define a flow path for fluid (e.g., water, air, etc.).

During operation, the flutes 921 of the guide post 902 aid in guiding movement of the float 903 relative to the guide post 902. Further, a bottom of the flutes 921 can be positioned at a predetermined height above the bottom wall 931 to act as a travel stop for the float 903. Notably, the predetermined height of the flutes 921 above the bottom wall 931 can be fixed or adjustable, such as through a telescopic or other connection of the flutes 921 to the central body 920.

Furthermore, although not shown in FIGS. 29 and 30, the flush valve 900 is configurable for use with other features disclosed herein. For example, an extender, such as the end extension 106 shown in FIG. 6 and discussed above, can couple to a top of the outer wall 930 to change an overflow height of the flush valve 900. Also for example, a disc (e.g., the disc 406 shown in FIG. 19 and discussed above, the disc shown in FIG. 32 and discussed below, etc.) can couple to the float 903, such as the bottom wall 931, to control buoyancy/timing of the float 903 during a flush cycle, as discussed herein. Also for example, the outer wall 930 of the float 903 can include one or more openings or sets of openings (e.g., openings 451, 452 shown in FIG. 10), which can be compatible with a covering member (e.g., one or more bands 454, plugs 456, or combinations thereof) to adjust an overflow height of the flush valve. It should go without saying, that these features as well as any other features disclosed herein are compatible with any other embodiment of this application.

Figure 31:
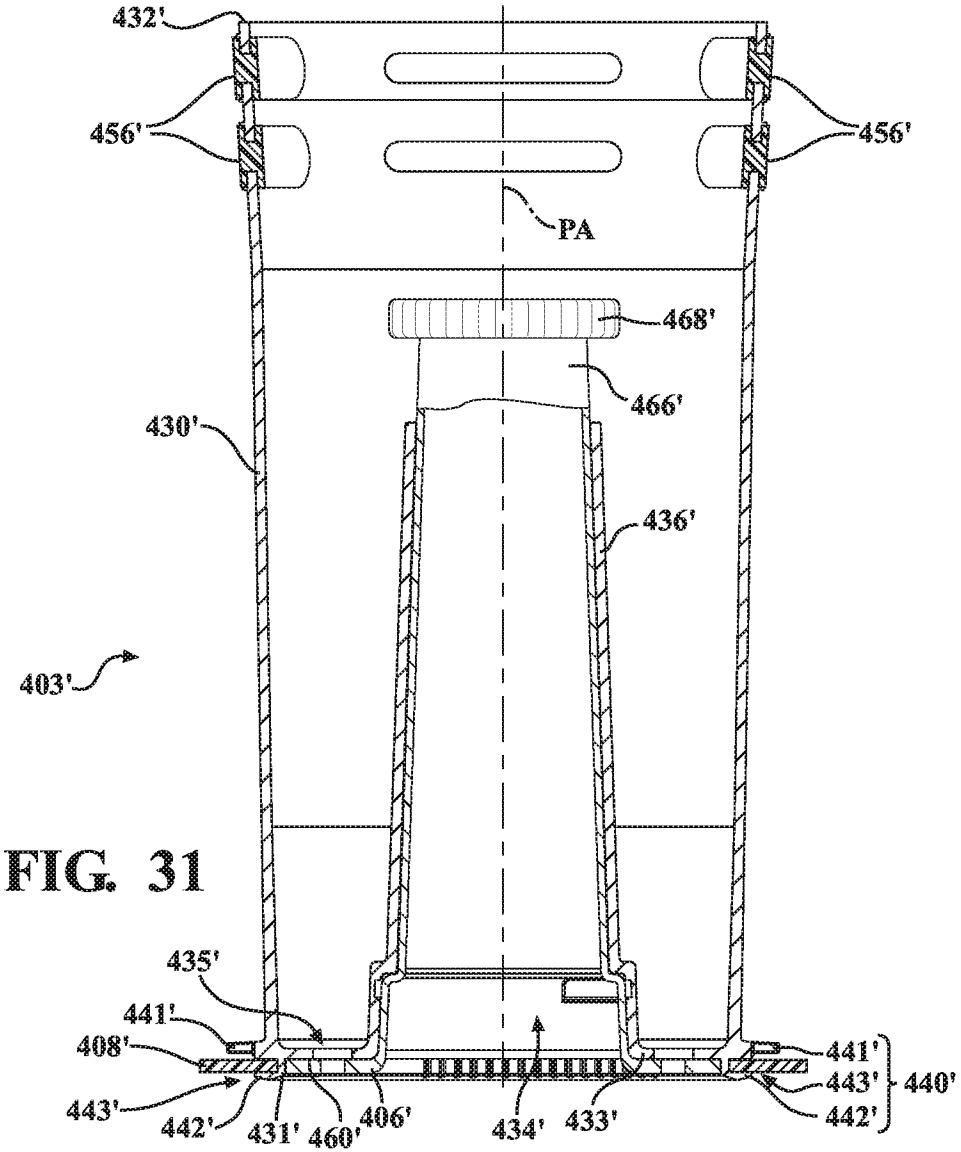
FIG. 31 is a cross-sectional view of a float assembly for use with a flush valve.

FIG. 31 illustrates an embodiment of a float assembly for use with a flush valve, such as any flush valve herein. The float assembly includes a float 403' and a disc assembly 406'. FIG. 31 shows the float 403' carrying a seal 408', which is optional. Notably, the elements and features shown in FIG. 31 that have reference numerals that correspond to reference numerals of the same number in FIG. 11 (albeit the numerals in FIG. 31 have an apostrophe or prime in addition to the numeral) have the same configuration as the corresponding element/feature in the embodiment of FIG. 11, except where otherwise noted. Thus, for example, the seal 408' shown in FIG. 31 can be carried in a recessed pocket 440', which is defined by an upper flange 441' and a lower flange 442' extending radially outward from opposite sides of a recess 443' disposed between the flanges 441', 442'.

The float 403' includes an outer wall 430', a bottom wall or bottom 433', and an inner wall 436'. The outer wall 430' extends longitudinally (e.g., generally vertically or upwardly) between a lower or first end 431' and an upper or second end 432'. The inner wall 436' extends upwardly defining a central opening 434'. FIG. 31 shows the inner wall 436' as having a frusto-conical shape, although the inner wall 436' can have other shapes (e.g., cylindrical, square, polygonal, etc.). The bottom 433' extends between a lower portion of the inner wall 436' and a lower portion of the outer wall 430'. The outer wall 430' of the float 403' can include one or more openings (e.g., openings 451, 452) proximate the second end 432'. One or more plugs 456' can selectively fill one or more of the openings in the outer wall 430' to adjust an overflow height of the flush valve. The bottom 433' can include one or more openings 435' that cooperate with a disc assembly, such as the disc assembly 406'.

The disc assembly 406' shown in FIG. 31 is configured differently from the embodiment shown in FIG. 11. Although the disc 406' includes a body 460', which can be configured basically the same as the body 460 discussed above, the disc 406' includes a shoulder 465' that is different from the shoulder 465. The shoulder 465' extends upwardly through the central opening 434', within the inner wall 436', and beyond a top of the inner wall 436'. An actuator 468' (e.g., dial, handle, etc.) is disposed on a distal end 466' of the shoulder 465' such that rotation of the actuator 468' in-turn rotates the body 460' of the disc 406' to change the positions of the one or more ports in the body 460' relative to openings 435' in the bottom 433' of the float 403'. In this way, the flow area between the ports in the body 460' and the openings 435' in the bottom 433' is adjustable from within the tank without having to disassemble the flush valve or use special tools. Notably, markings can be included, such as between the actuator 468' and the float 403' (e.g., inner or outer walls) to reflect a level of performance of the flush valve based on a setting of the flow area.

Figure 32:
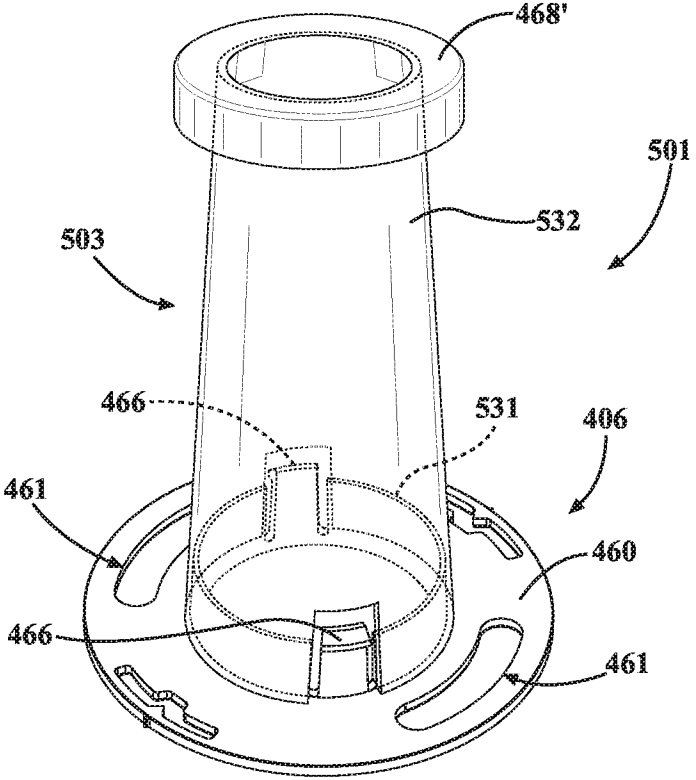
FIG. 32 is a perspective view of a disc assembly for use in a float assembly, such as the float assembly shown in FIG. 31.

FIG. 32 illustrates an embodiment of a disc assembly 501 for use in a float assembly, such as the float assembly shown in FIG. 31. The disc assembly 501 is similar to the disc assembly 406', except the disc assembly 501 is a two-piece design. The disc assembly 501 includes a first part in the disc 406, and a second part in the extension 503. As shown, the disc 406 is configured the same as described above, with the body 460 and snap-features 466, among the other features/elements. The illustrated extension 503 has a tubular (e.g., frusto-conical) shape tapering from a first or lower end 531 toward a second or upper end 532. The lower end 531 attaches the snap-features 466 and/or the shoulder 465 of the disc 406 to secure the two components together. An actuator 468' is disposed on the distal upper end 532 of the extension 503 such that rotation of the actuator 468' in-turn rotates the extension 503 and the disc 406 (e.g., by the same angular rotation) to change the positions of the one or more ports 461 in the body 460 relative to openings (e.g., openings 435') in the float (e.g., float 403').

Refill restrictors are usually part of the fill valve, not the flush valve. They are customarily a small plastic part that inserts into the bowl refill water port on the side of the fill valve. Many restrictors are made to be interchangeable, and are available in a variety of restriction percentages. Further, manufacturers produce different types of refill restrictors, such as ones for high flow rate valves and others for low flow rate valves. Each type of restrictor has a plurality of flow restriction percentages available, labeled by the percentage of overall valve flow delivered through the refill tube port. For example, a 10% restrictor will deliver 10% of the overall water volume to the bowl through the refill tube and 90% to the tank after a flush. An integral refill restrictor adjustable/non-adjustable built into the flush valve would provide several advantages, some of which include less parts on the fill valve, possible cost reduction from suppliers, consolidation of fill valve SKUs and associated management costs, consolidation and reduction of inventory, and higher range of adjustability for bowl refill volume. A variable flow rate/adjustable refill restrictor could be integrated into the cap or center guide of the flush valve allowing for factory or consumer in tank adjustment without the need for acquiring numerous restrictor inserts for the fill valve.

It is noted that any two components of any float assembly disclosed herein can be formed using a co-molding (e.g., over-molding, two-shot injection molding) process. For example, a rotating disc/dial can be co-molded with a canister/float, such as where the disc (e.g., disc 406) is co-molded onto the bottom of the float/canister such as in a two shot and/or over mold process. This advantageously enables designs that might not otherwise be possible, such as, by inducing less stress on the plastics (e.g., a molded-in part, like the disc/dial, would not require flexible attachment points that are stressed upon insertion, which can create weak areas in the part that eventually fail), eliminating or reducing post forming (e.g., secondary) assembly operations, and/or providing increased durability, such as by reducing or eliminating encapsulated parts from falling apart or separating during shipping, use, etc.

At least one embodiment of the present application includes a valve body, a guide post, a float, and an extender. The valve body is configured to be fixed relative to a toilet tank and having a hollow wall defining an internal flow passage. The guide post couples to and extends away from the valve body. The float fits about and slides relative to the guide post between a closed position and an open position, and the float has an open top. The extender selectively couples to the open top in a first position, in which a first end of the extender is received in and couples to the open top, and in a second position, in which a second end of the extender is received in and couples to the open top, such that the extender and float define a first overflow height in the first position and define a second overflow height in the second position.

The extender can be removable from the open top, such that the open top defines a third overflow height with the extender removed. The extender can include a hollow body extending between the first and second ends; and a rib or a flange extending radially inward from an inner surface of the body or radially outward from an outer surface of the body, where the rib/flange is located longitudinally a first distance from the first end and a second distance from the second end. For example, a first surface of the rib/flange can contact the float (e.g., the open top) in the first position, and a second surface of the rib/flange can contact the float (e.g., the open top) in the second position. The rib/flange can have an annular or other suitable shape.

The float can include a bottom that extends radially inward (e.g., from the outer wall), where the bottom has at least one opening therein that influences the buoyancy of the float. For example, bottom can include a first opening having a first flow area and a second opening having a second flow area, which is greater or less than the first flow area.

At least one embodiment of the present application includes a valve body, a guide post, a float, and a disc. The valve body is configured to fixedly couple to a toilet and having a hollow wall defining a flow passage. The guide post couples to and extends away from the valve body. The float fits about and moves relative to the guide post between a closed position and an open position. The float can include an outer wall extending between a first end and a second end, which is open; an inner wall configured to move along the guide post; and a bottom extending between the inner wall and the outer wall, the bottom having one or more openings (e.g., elongated slots) therein. The disc rotatably couples to the float and is disposed adjacent to the bottom, such that relative rotation between the disc and the float adjusts the location of one or more ports (e.g., elongated slots) of the disc relative to the one or more openings in the bottom to a change a flow area.

A recess in the float can receive an outer periphery of the disc, where the recess extends inwardly into the outer wall of the float. The float can include a flange extending radially outward from the outer wall, with the flange defining a pocket that carries a seal, which selectively seals against a valve seat of the valve body.

The flush valve can include an extender, such as one discussed above.

At least one embodiment of the present application includes a valve body, a guide post, a float, and a covering member. The valve body is configured to fixedly couple to a toilet and has a hollow wall defining a flow passage. The guide post couples to and extends away from the valve body. The float fits about and moves relative to the guide post between a closed position and an open position. The float has an outer wall extending between a first end and a second end, which is open, the outer wall having one or more first openings at a first distance from the second end and one or more second openings at a second distance from the second end. The float has an inner wall configured to move along the guide post. The covering member adjustably couples to the float, wherein the covering member covers each first opening in a first position to define a first overflow height, each second opening in a second position to define a second overflow height, and all of the first and second openings in a third position to define a third overflow height. The covering member can include one or more annular bands or one or more plugs.

A valve nut can be included to thread to the valve body to secure the valve body to the toilet tank. Each flush valve can be part of a toilet having a toilet bowl and a toilet tank, where the (internal) flow passage of the valve body is configured to direct flush water from the toilet tank to the toilet bowl during a flush cycle of the toilet.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the flush valves, as shown in the various exemplary embodiments, are illustrative only. Additionally, any element disclosed in one embodiment may be incorporated or utilized with any other embodiment disclosed herein. For example, the float, valve, components and aspects thereof described in any one paragraph may be incorporated with any other exemplary embodiment described in any other paragraph in the application. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A universal canister flush valve, comprising:

a valve body configured to be fixed relative to a toilet tank and having a hollow wall defining an internal flow passage;

a guide post coupled to and extending away from the valve body;

a float fitted about and configured to slide relative to the guide post between a closed position and an open position, the float having an open top; and an extender that selectively couples to the open top in a first position, in which a first end of the extender is received in and coupled to the open top, and in a second position, in which a second end of the extender is received in and coupled to the open top, wherein the extender and float define a first overflow height in the first position and define a second overflow height in the second position, wherein the extender comprises:

a hollow body extending between the first and second ends; and a rib or a flange extending radially inward from an inner surface of the body, wherein the rib or the flange is located longitudinally a first distance from the first end and a second distance from the second end.

2. The universal canister flush valve of claim 1, wherein the extender is removable from the open top, such that the open top defines a third overflow height with the extender removed.

3. The universal canister flush valve of claim 1, wherein a first surface of the rib contacts the float in the first position, and a second surface of the rib contacts the float in the second position.

4. The universal canister flush valve of claim 3, wherein the rib has an annular shape.

5. The universal canister flush valve of claim 1, wherein the flange includes a first surface, which contacts an end of the open top in the first position, and a second surface, which contacts the end of the open top in the second position.

6. The universal canister flush valve of claim 1, wherein the float includes a bottom that extends radially inward, the bottom having at least one opening therein that influences the buoyancy of the float.

7. The universal canister flush valve of claim 6, wherein the at least one opening in the bottom comprises:

a first opening having a first flow area; and a second opening having a second flow area, which is greater or less than the first flow area.

8. A toilet comprising:

the universal canister flush valve of claim 1;

a toilet bowl;

the toilet tank; and a valve nut that threads to the valve body to secure the valve body to the toilet tank, wherein the internal flow passage of the valve body is configured to direct flush water from the toilet tank to the toilet bowl during a flush cycle of the toilet.

9. A universal canister flush valve, comprising:

a valve body configured to fixedly couple to a toilet and having a hollow wall defining a flow passage;

a guide post coupled to and extending away from the valve body;

a float fitted about and configured to move relative to the guide post between a closed position and an open position, the float comprising:

an outer wall extending between a first end and a second end, which is open;

an inner wall configured to move along the guide post; and a bottom wall extending between the inner wall and the outer wall; and a disc rotatably coupled to the float and disposed adjacent to the top of the inner wall, such that relative rotation between the disc and the float adjusts at least one port of the disc relative to at least one opening in the top of the inner wall to change a flow area.

10. The universal canister flush valve of claim 9, wherein the at least one opening comprises a plurality of elongated slots, and the at least one port comprises a plurality of elongated slots.

11. The universal canister flush valve of claim 10, further comprising:

an extender that selectively couples to the second end of the outer wall in a first position, in which a first end of the extender couples to the outer wall, and in a second position, in which a second end of the extender couples to the outer wall, wherein the extender and float define a first overflow height in the first position and define a second overflow height in the second position.

12. A toilet comprising:

a toilet bowl, a toilet tank, and the universal canister flush valve of claim 9, wherein the flow passage of the valve body is configured to direct flush water from the toilet tank to the toilet bowl during a flush cycle of the toilet.

13. A universal canister flush valve, comprising:

a valve body configured to fixedly couple to a toilet and having a hollow wall defining a flow passage;

a guide post coupled to and extending away from the valve body;

a float fitted about and configured to move relative to the guide post between a closed position and an open position, the float comprising:

an outer wall extending between a first end and a second end, which is open;

an inner wall configured to move along the guide post; and a bottom wall extending between the inner wall and the outer wall; and a disc rotatably coupled to the float and disposed adjacent to the bottom wall or a top of the inner wall, such that relative rotation between the disc and the float adjusts at least one port of the disc relative to at least one opening in the bottom wall or the top of the inner wall to change a flow area, wherein a recess in the float receives an outer periphery of the disc, and the recess extends inwardly into the outer wall of the float; the float includes a flange extending radially outward from the outer wall; and the flange defines a pocket that carries a seal, which selectively seals against a valve seat of the valve body.

14. The universal canister flush valve of claim 13, wherein the disc is disposed adjacent to the bottom wall, such that relative rotation between the disc and the float adjusts the at least one port of the disc relative to the at least one opening in the bottom wall.

* * * * *